US006443363B1

(12) United States Patent
Fasano

(10) Patent No.: US 6,443,363 B1
(45) Date of Patent: Sep. 3, 2002

(54) SUPPORT DEVICE FOR RAILS OF RAILWAY TRACKS

(75) Inventor: Eleonora Fasano, Livorna Ferra-is (IT)

(73) Assignee: Effebi Technologies S.r.l., Vercelli (IT)

( * ) Notice: Subject to any disclaimer, the term of this patent is extended or adjusted under 35 U.S.C. 154(b) by 0 days.

(21) Appl. No.: 09/631,297

(22) Filed: Aug. 2, 2000

(30) Foreign Application Priority Data

Aug. 3, 1999 (IT) ..... TO99A0689

(51) Int. Cl.[7] ..... E01B 21/02

(52) U.S. Cl. ..... 238/336; 238/121; 238/310; 246/447

(58) Field of Search ..... 238/121, 310, 238/336, 349, 351, 352, 353, 354, 382, 340; 248/200; 246/477; 403/384, 403

(56) References Cited

U.S. PATENT DOCUMENTS 269,955 A * 1/1883 Paulin ..... 246/477
1,852,469 A * 4/1932 Muller ..... 238/336
3,974,963 A * 8/1976 Noble et al. ..... 238/382
5,038,704 A * 8/1991 Dean et al. ..... 116/173
606,197 A * 6/1998 Dunn ..... 246/477
6,138,921 A * 10/2000 Espinosa ..... 238/334

* cited by examiner

*Primary Examiner*—S. Joseph Morano
*Assistant Examiner*—Frantz F. Jules
(74) *Attorney, Agent, or Firm*—Sughrue Mion, PLLC

(57) ABSTRACT

A support device which can be applied to rails (R) of railway or tram tracks includes a bracket (1) having two attachment parts (6) for attachment to the rail (R) on opposite sides of a sleeper (T), a resting part (4) which rests on the sleeper (T), and is set at a distance from the attachment parts (6), and clamp members (7) for connection of the attachment parts (6) to the flange (S) of the rail (R). The bracket is arranged for supporting a service device such as a transit platform, sound barriers or other devices.

18 Claims, 23 Drawing Sheets

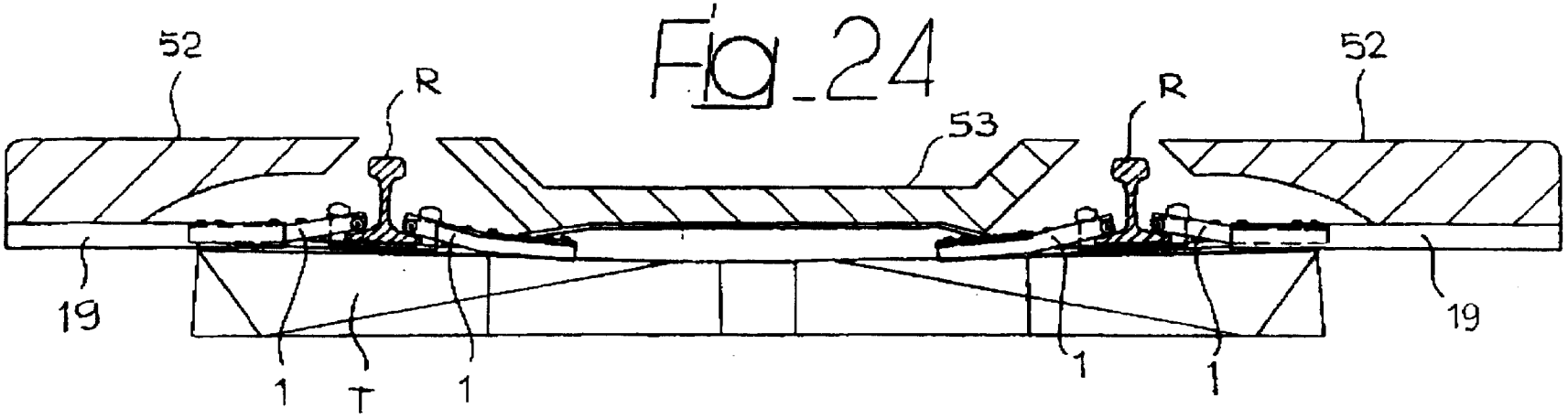
Fig_24
Fig_25
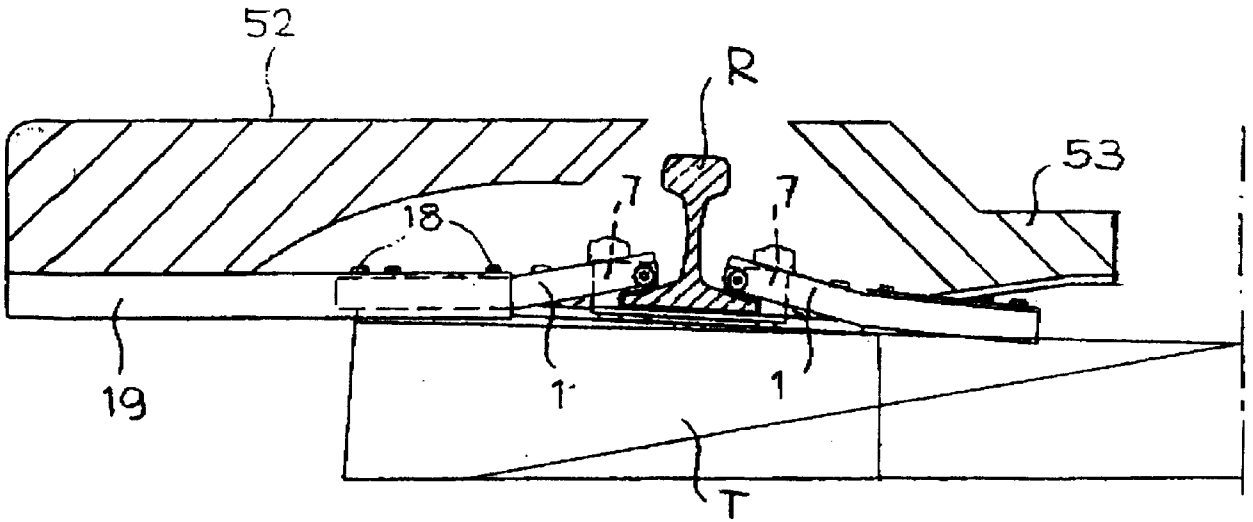

64
7
R
8
1
T
19
65
66
67
15
18

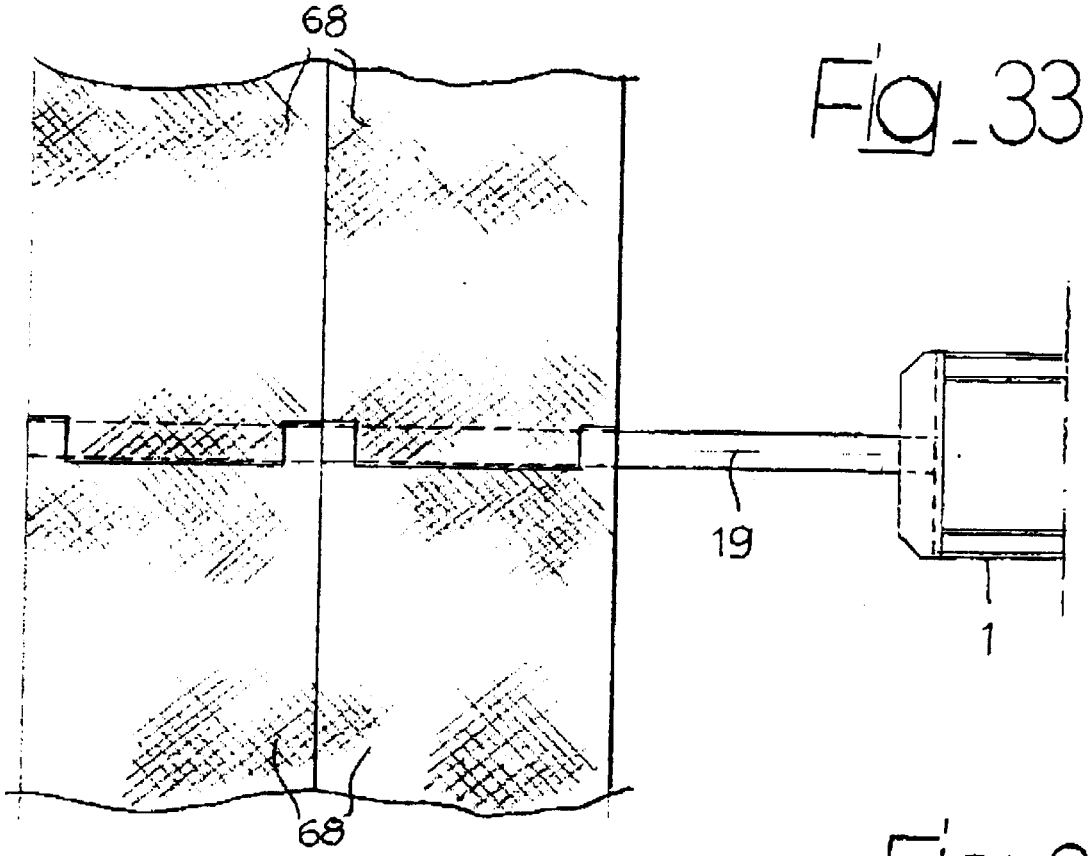
Fig_33
Fig_34
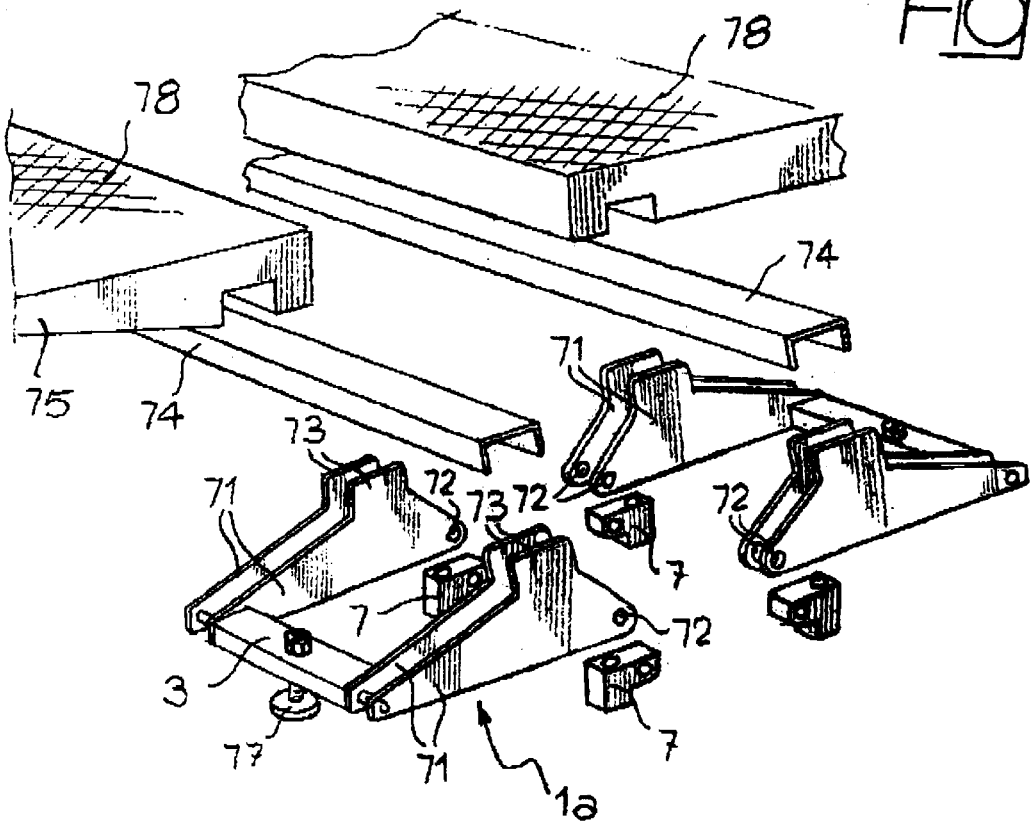

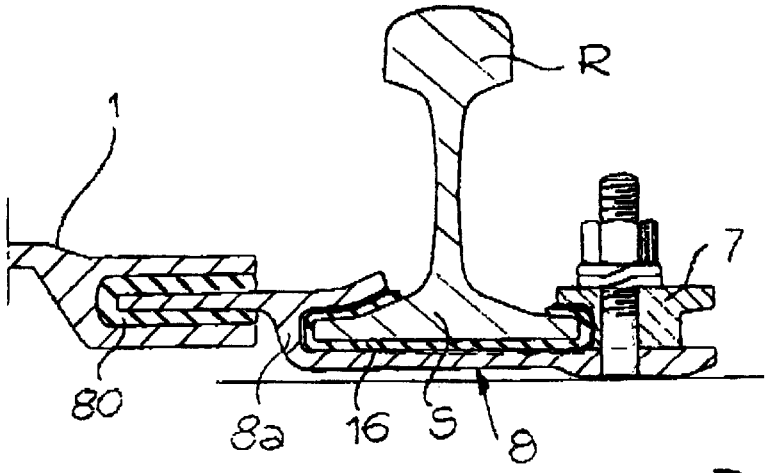
Fig_40
Fig_41
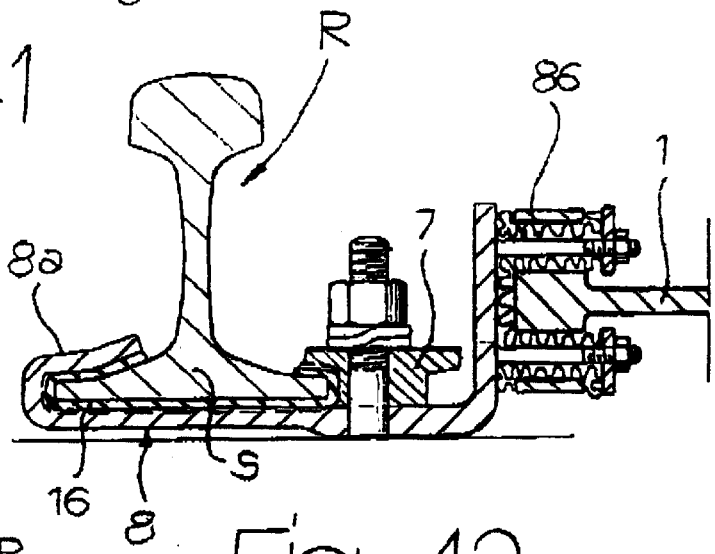
Fig_42
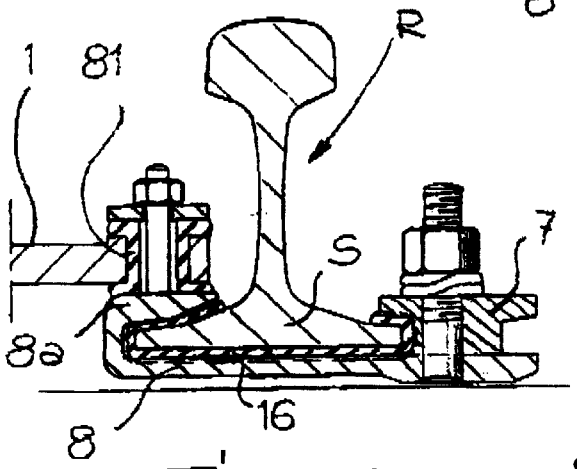
Fig_43
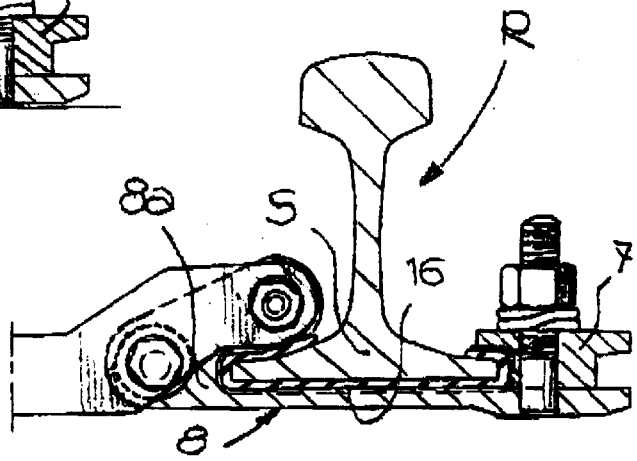

SUPPORT DEVICE FOR RAILS OF RAILWAY TRACKS

BACKGROUND OF THE INVENTION

The present invention relates in general to railway (and tram) tracks and has the purpose of providing a support device that can be applied to rails of the said tracks with the aim of making available useful and practical functions, of course without affecting in the least either the operation or the maintenance of the railway track itself.

SUMMARY OF THE INVENTION

More in particular, the subject of the invention is a support device for rails of railway (and tram) tracks that include sleepers set at intervals apart and in which said rails have flanges fixed to said sleepers, where the said device may be applied to already existing rails, at the side of the rail along one side of the track, or even within the track itself, in a simple, fast and convenient way, and without any need to intervene on the connection between rails and sleepers, so as to serve as a support for service devices chosen from among a plurality of possible options.

A further object of the invention is to provide a support device that can be applied to rails of railway (and tram) tracks which has a simple, inexpensive, and sturdy structure, as well as being designed to guarantee maximum safety as regards static and dynamic loads during use.

According to the invention, the above objects are achieved by providing a support device for applications of the type specified above, the basic characteristic of which lies in the fact that it includes a bracket having parts for attachment to a rail on either side of a sleeper, a resting part intended to rest on the sleeper, said part being spaced from said attachment parts, and mechanical connection means for connecting said attachment parts to the flange of the rail.

Conveniently, said fixing means include clamp members for both sides of the flange of the rail.

BRIEF DESCRIPTION OF THE DRAWINGS

The invention will now be described in detail with reference to the guessed drawings, which are provided purely as non-limiting examples, and in which:

FIGS. 24–32 are views similar to that of FIG. of the support device according to the invention;

FIG. 33 is a partial plan view of FIG. 30;

FIG. 34 is an exploded perspective view similar to that of FIG. 5*b*, which illustrates a variant of the support device according to the invention;

FIGS. 40–43 are views similar to that of FIG. 7, at a larger scale, which illustrate further variants of the support device according to the invention.

DESCRIPTION OF THE INVENTION

Figure 1:
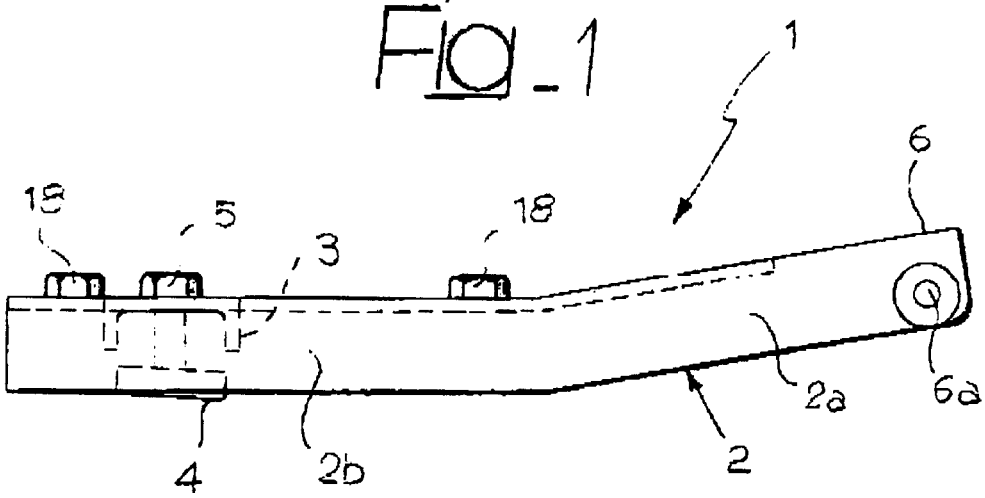
FIG. 1 is a schematic side elevation of a bracket that constitutes one of the components of the support device for railway tracks according to the invention.
Figure 2:
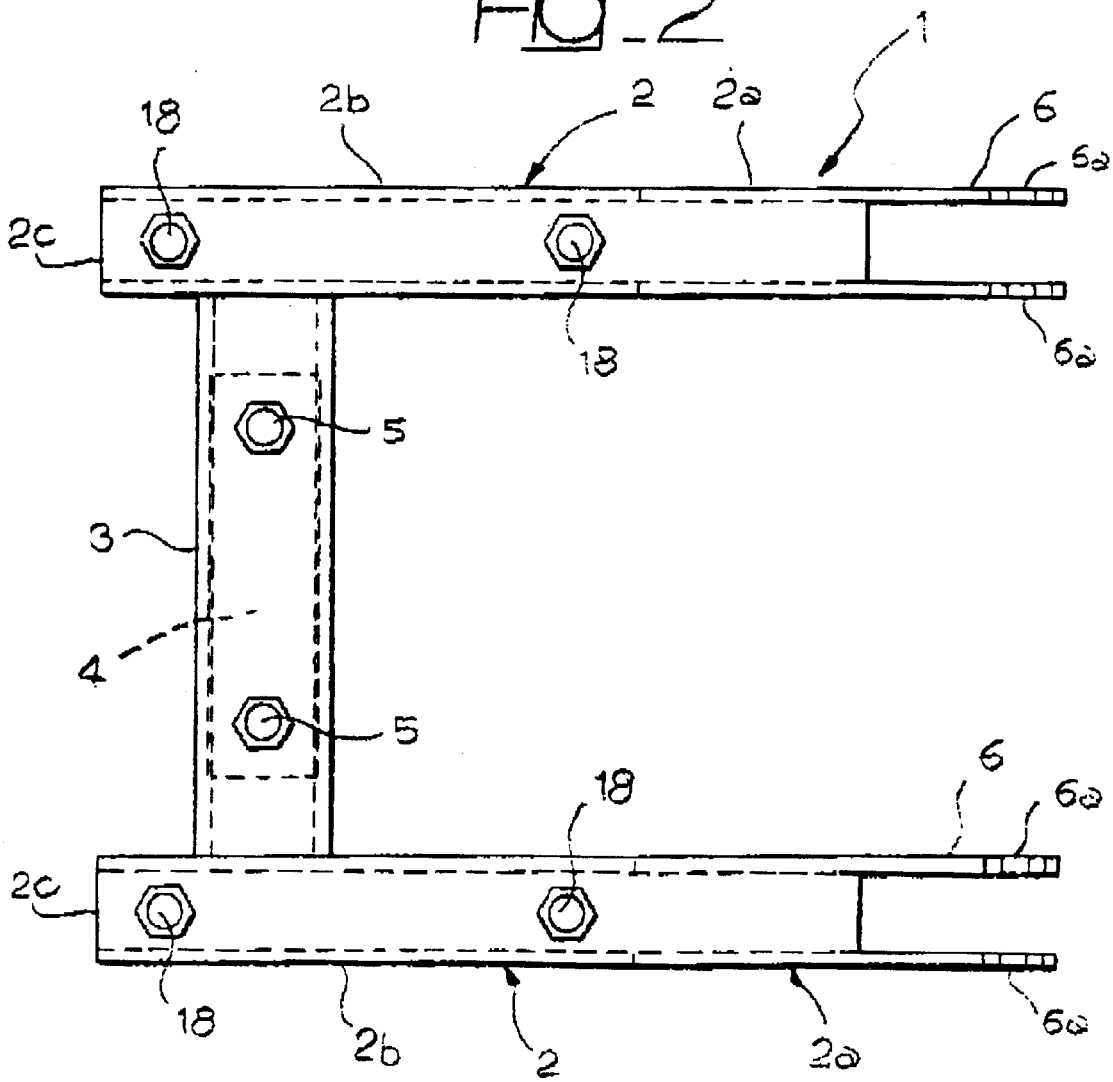
FIG. 2 is a top plan view of FIG. 1.
Figure 3:
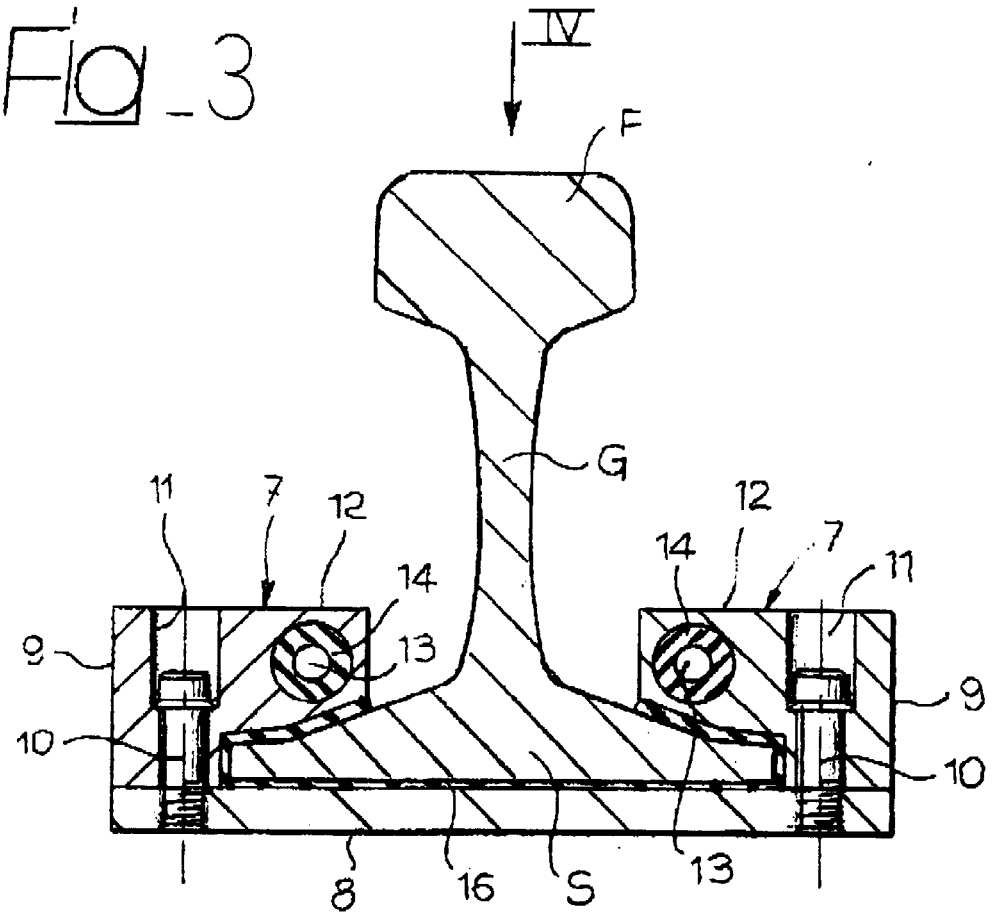
FIG. 3 is a schematic cross-sectional view showing the remaining components of the support device according to the invention, as these are applied to a railway track according to one first embodiment.
Figure 4:
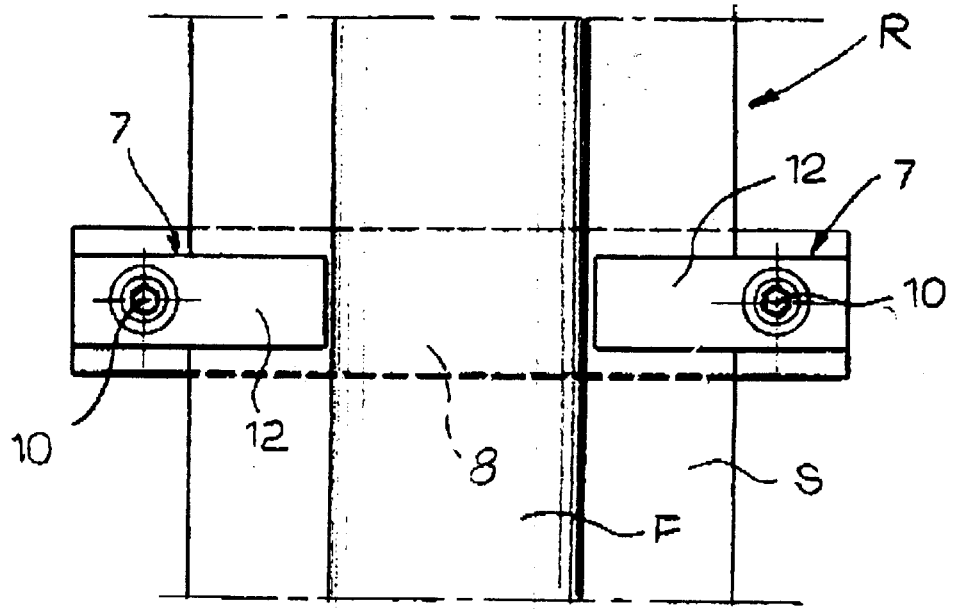
FIG. 4 is a top plan view of FIG. 3.
Figure 5A:
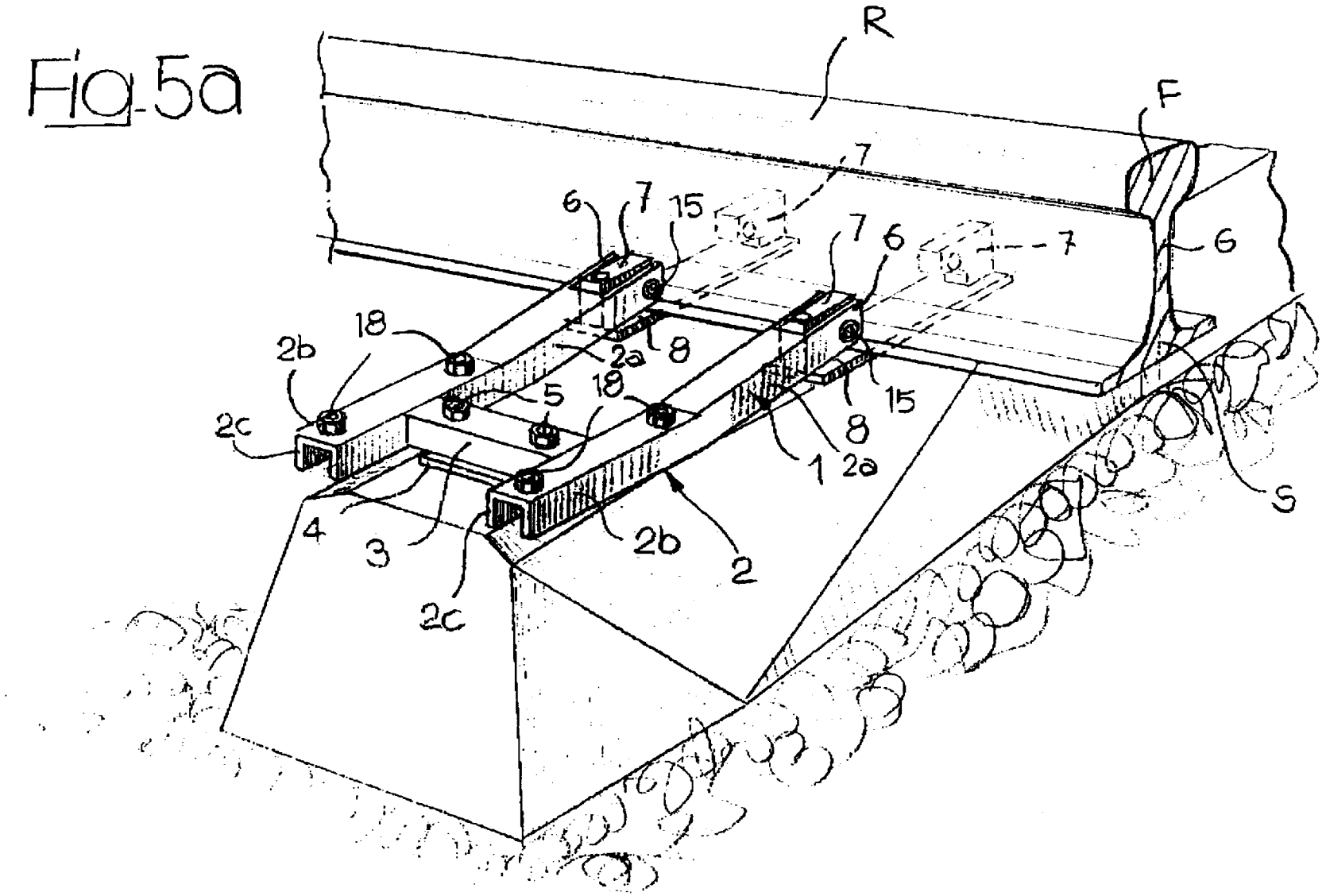
FIG. 5*a* is a perspective view showing the ensemble of the support device according to the invention made up of the components of FIGS. 1–4.
Figure 7:
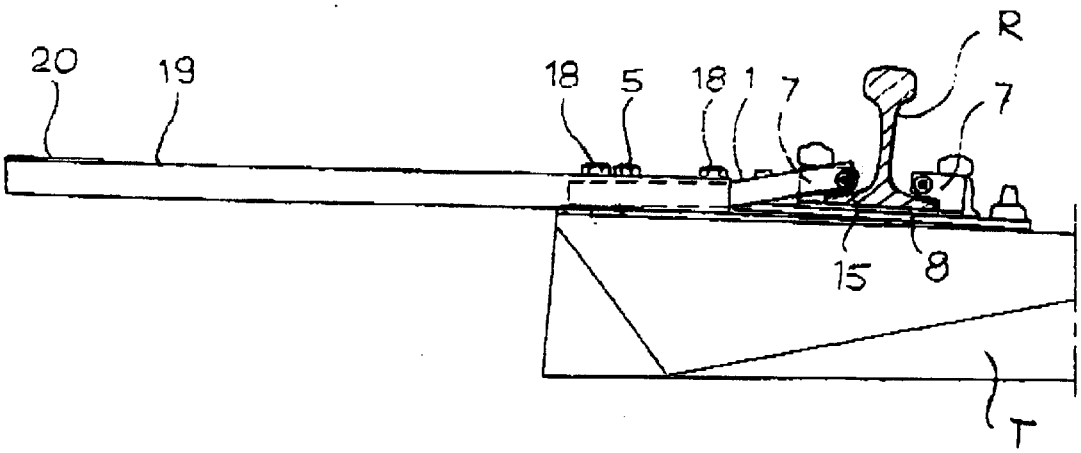
FIG. 7 is a cross-sectional schematic view, at a reduced scale, illustrating the support device of the invention according to a first possible example of use.

With reference initially to FIGS. 1 and 2, the number 1 generically designates a bracket which constitutes a component of a support device according to the invention, which can be applied to the rails of railway (or tram) tracks. An example of such e. rail is illustrated in FIG. 3 and in practically all the other figures of the attached drawings. The said rail, designated as a whole by R, is, for example, of the type having a UNI 60 or UNI 50 standard profile, and comprises a web G. a flange S, and a head F. A railway track to which the support device according to the invention may be applied normally comprises a pair of parallel rails R, the flanges S of which are fixed, according to conventional means, to a series of sleepers set at intervals apart, of the type designated by T in. FIG. 7 and subsequent figures, and more clearly visible in FIG. 5*a*.

Figure 5B:
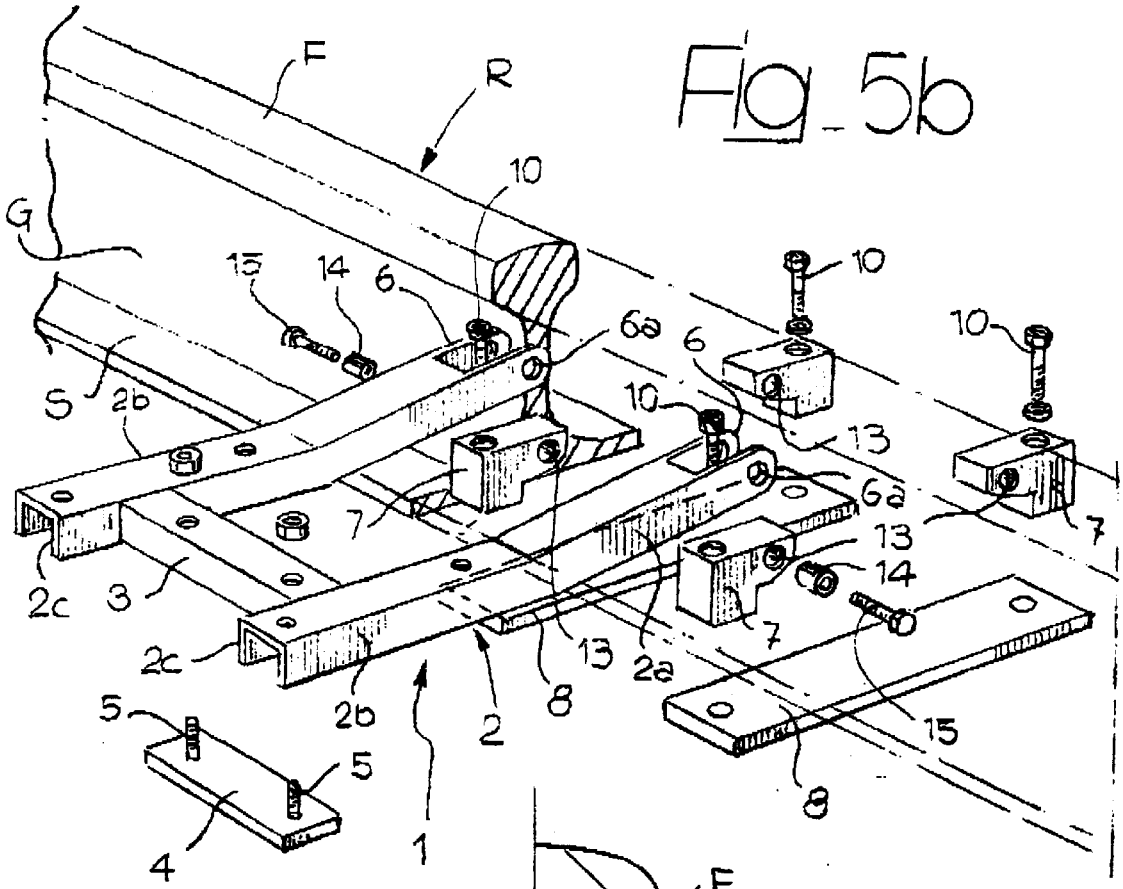
FIG. 5*b* is an exploded view of FIG. 5*a;*

In the case of the first embodiment illustrated, the bracket 1 is made up of a pair of parallel arms 2, each of which consists of a inverted-channel section made of metal (FIGS. 5*a* and 5*b*) and has an initial, or internal, portion 2*a* which is slightly inclined downwards, and an end, or external, horizontal portion 2*b* (in the ensuing description, the terms 'horizontal', 'vertical', and equivalent or similar terms are understood as referring to the condition in which the support device is applied to the rail R).

The portions 2*a* and 2*b* have approximately the same length, and the portions 2*b* are rigidly interconnected in the vicinity of their ends 2*c* opposite to the portions 2*a* by a transverse element or cross member 3. Also the cross member 3 may be made of an inverted-channel section, provided at the bottom with a base plate 4 fixed in a rigid way, or, more conveniently, in such a way that it is height-adjustable by means of a pair of vertical screws 5. As will be seen from what follows, the base plate 4 constitutes a supporting part for the bracket 1 on the sleeper T.

The ends of the inclined portions 2*a* of the two arms 2 are shaped like identical yokes or forks 6 which define respective attachment parts for the bracket 1 to the flange S of the rail R by means of a system of mechanical connection, described in detail in what follows.

As may be better seen in FIGS. 3, 4 and 5*a*, 5*b*, in the case of the embodiment illustrated, the aforesaid fixing system included, for each fork 6 of the bracket 1, a pair of clamp members 7 conveniently identical to one another, set on either side of the flange S of the rail R and fixed to a base plate 8 clamped against the bottom surface of the flange S. The two pairs of clamp members 7 with their respective base plates 8 are located on opposite sides with respect to the sleeper T, in order not to interfere with the latter.

Each clamp member 7 is made up of a basically L-shaped block having an outer vertical branch 9 for anchoring the plate 8 by means of at least one screw 10 inserted in a vertical through hole 11, and a horizontal branch 12 which having a shape complementary to that of the back of the flange S and which can be engaged from above against the latter.

The horizontal branch 12 of each clamp block 7 has a horizontal through hole 13 in which is housed a bushing 14, conveniently but not necessarily made of vibration-damping material, for example rubber.

As may be clearly seen in FIG. 3, the horizontal branches 12 of the clamp blocks 7 have a shaped underneath which is complementary to the back and side surfaces of the flange S of the rail R and, as a result of tightening of the corresponding screws 10, the clamp blocks 7 are firmly fixed to the base plate 8 against the flange S. The two pairs of clamp blocks 7 set on either side of the rail R have their horizontal holes 13 aligned together parallel to the longitudinal direction of the rail R.

In the case of the example that will now be described, the two clamp blocks 7 set on the outer side of the rail R constitute the parts of mechanical connection of the bracket 1 to the rail R: in fact, the forks 6 are set astride of the said clamp blocks 7 and arc connected to the latter by means of respective bolts 15 inserted in the holes 13 and in the vibration-damping bushings 14, and through corresponding horizontal holes 6*a* of the forks 6. In this way, the bracket 1 is in practice able to oscillate with respect to the rail R; however, it should be pointed out that the connection between the said bracket 1 and the flange S of the rail R could instead be rigid.

Figure 6:
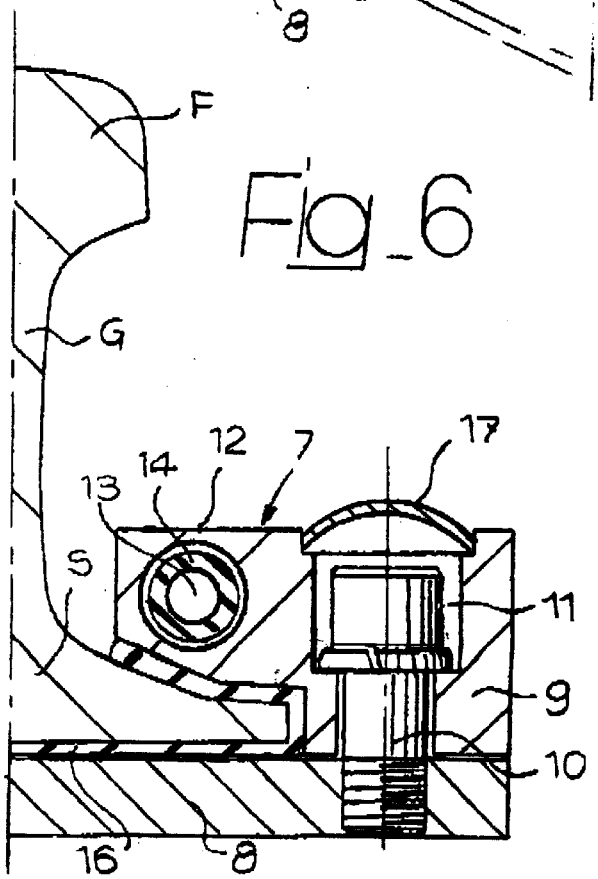
FIG. 6 illustrates, at a larger scale, a detail of FIG. 3 according to a variant.

The holes 11 of the clamp blocks 7 may be closed from above by means of protective caps 17, in the way illustrated in detail in FIG. 6.

The other pair of clamp blocks 7 is used in the embodiment now described only to complete the mechanical connection of the bracket 1. It should, however, be pointed out that, as will be described in what follows, the said clamp blocks 7 may be used also for attaching another bracket, which may be the same as or different from the bracket 1, at the inner side of the rail R.

When the support device is mounted on the rail R, the clamp blocks 7 are positioned, as has been said, on either side of the sleeper T and adjacent to the latter. The distance between the two arms 2 of the bracket 1 will obviously be greater than the width of the sleeper T. Consequently, the arms 2 do not interfere with the latter. The cross member 3 rests, instead, on the sleeper T with its base plate 4, and, as has been said, this support can be adjusted vertically by means of the screws 5.

The clamp blocks 7 and the plate a are normally made of metal, as are the components of the bracket 1 (even though they could possibly be made using high-resistance plastic materials). For this reason, it is necessary, in order to prevent onset of parasitic currents, to insulate the support device according to purpose, between the flange S of the rail R and the clamp blocks 7 on the one side, and the base plate on the other, a layer of electrically insulating material 16 is interposed, which will also conveniently have vibration-damping properties. The layer 16 may thus normally be made of rubber or a similar material.

From the foregoing description it will be evident that the application of the support device according to the invention to already existing rails R may be made in an easy and convenient way, without requiring even partial removal of the ballast. In the applied condition, the support device does not interfere with the machines normally used for carrying out ballasting operations, and the load exerted on the said support device (as will be clarified in what follows) is properly distributed and discharged on the sleeper T. The support device, which, according to the applications, may be applied in positions corresponding to each sleeper T or to every other sleeper T, is able to withstand static loads of considerable size, and the corresponding dynamic reactions will normally be exerted,. in the presence of transit of a railway vehicle, on the rail R.

In the applications that will be described in what follows, the bracket 1, connected in an oscillating way (by means of the bolts 15 ) to the clamp blocks 7 and to the corresponding support 4, which is height-adjustable (by means of the screws 5 ) and reacts on the sleeper T. supports (normally in cantilever fashion) one or more service devices, which are in turn rigidly fixed to the arms 2 of the bracket 1 by means of screws 18 or equivalent systems (welding, etc.).

The simplest application is represented in FIG. 7, where a projecting service member 19 is envisaged, consisting of, for example, an arm, a pair of arms, or a plate, the free end of which has an attachment base 20 that can be used, for instance, to support a railway signal (semaphore, flag, etc.) or an acoustic communication unit (loudspeaker, siren, etc.), and the like. As may be seen, the service member 19 projects well beyond the corresponding end of the sleeper T, alongside the railway track.

Figure 8:
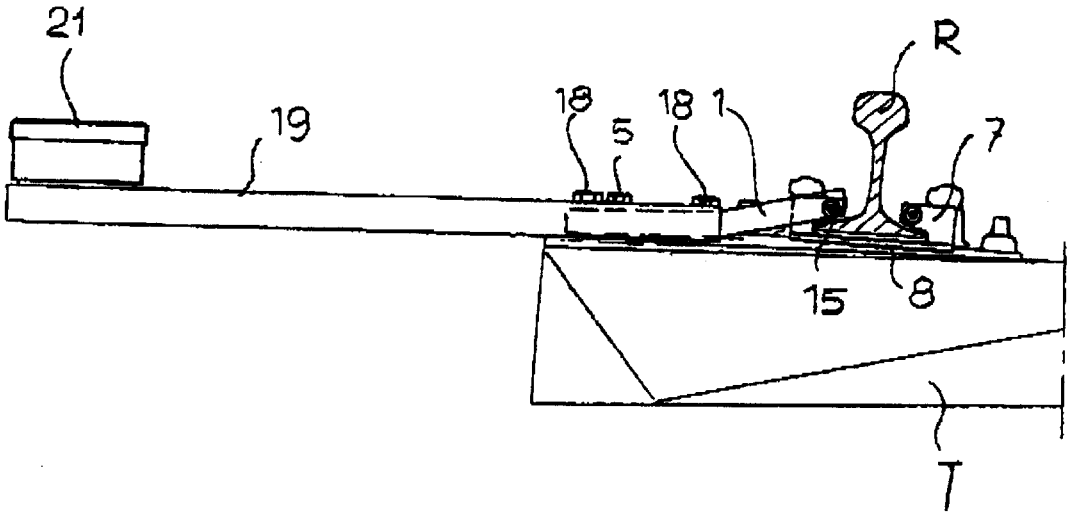
FIGS. 8–13 illustrate further alternative examples of use of the support device according to the invention.

In the case of FIG. 8, the projecting service member 19 is arranged for supporting, at its free end, a duct 21 for electrical cables or signal cables, the said duct 21 extending in a continuous way parallel to the railway track.

Figure 9:
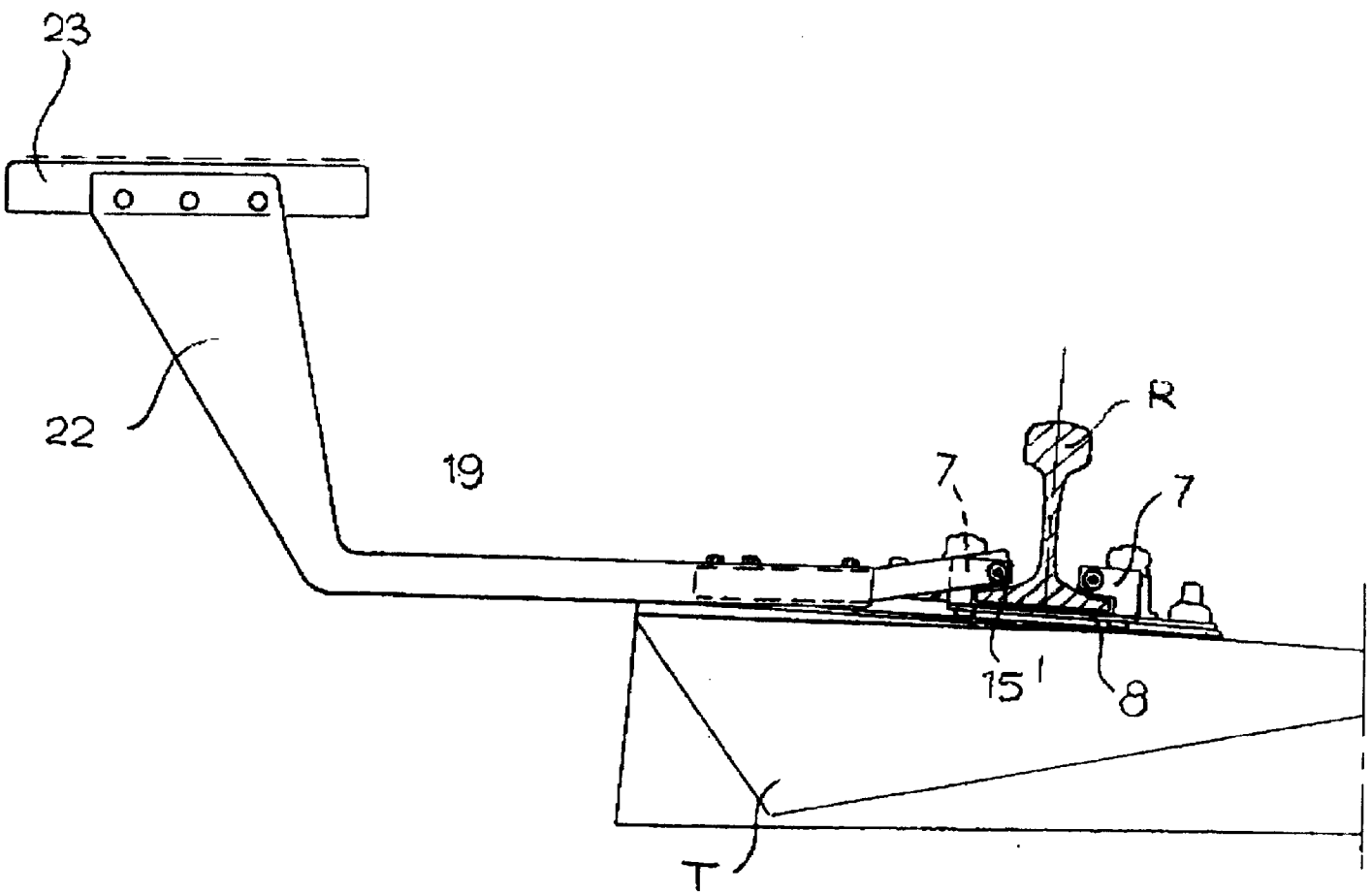

In the case of FIG. 9, the projecting service member 19 has, at its free end, one arm 22 or a pair of arms 22 bent upwards and arranged for supporting a structure 23 consisting, for example, of a platform prolongation, a rail-support platform in points corresponding to maintenance areas, temporary stations, military equipping areas, and/or emergency areas, etc.

Figure 10:
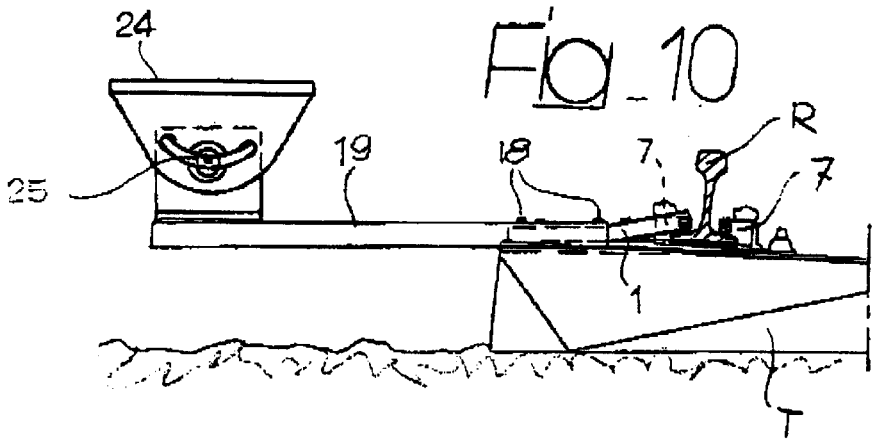

In FIG. 10, the projecting service member 19 carries, at its free end, a platform 24, which is supported in 25 in an orientable way so that it can set itself horizontally even though the support device 1 with the projecting service member 19 is positioned so that it is inclined.

Figure 11:
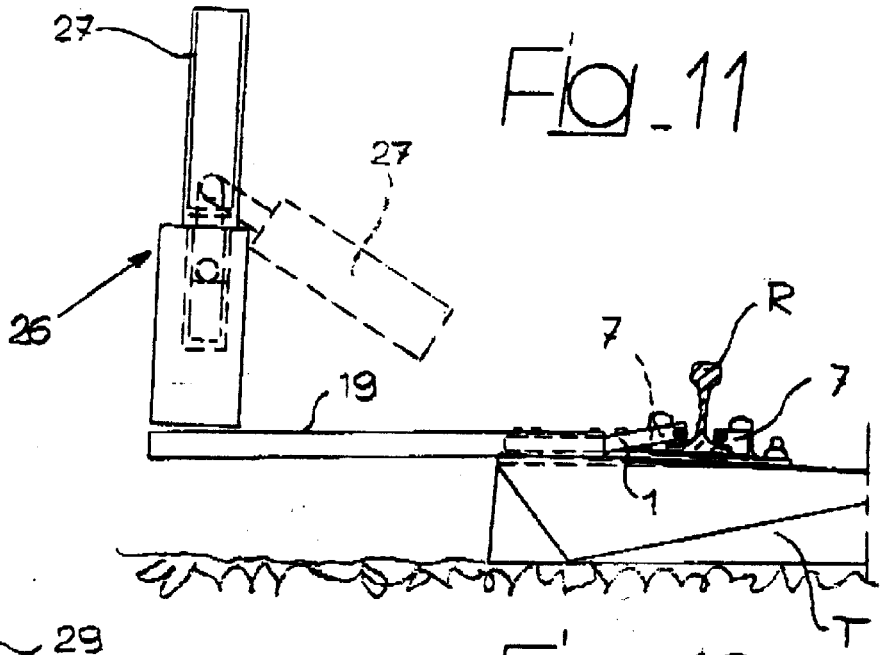

In the case of FIG. 11, the projecting service member 19 supports, at its free end, a sound barrier 26 having a top part 27 that can be turned down to enable passage along the railway line of trains with rolling stock that is out of clearance gauge.

Figure 12:
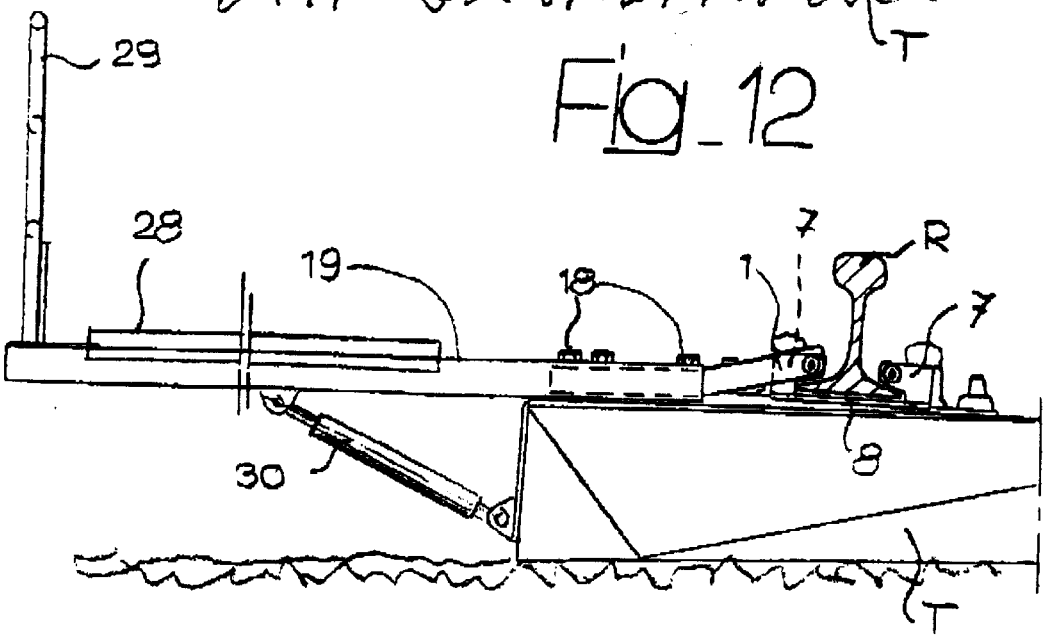

In FIG. 12, the projecting service member 19 supports, in addition to a horizontal platform 28, also a vertical board or safety barrier 29. In this case, the service member 19 may project further and be supported underneath by an oblique strut 30, which reacts underneath with the end of the sleeper T.

FIGS. 13, 14 and 15, 16 illustrate the use of the support device according to the invention for supporting a treading surface 31, for example made of prefabricated concrete, usable as gangway, cycle path, and the like. In this case, the projecting service member 19 has stiffening side plates 20 and carries at its free end a vertical tubular element 32 in which a compression guiding and supporting strut member 33 is engaged, the latter in turn serving as the support of a first longitudinal guide 34 having an inverted-channel shape. A second, identical, longitudinal guide 35 is supported on screw-adjustable supports 36 that react with the ground. on the longitudinal guides 34 and 35, corresponding bottom longitudinal recesses 37 and 38 of the treading surface 31 engage.

Figure 13:
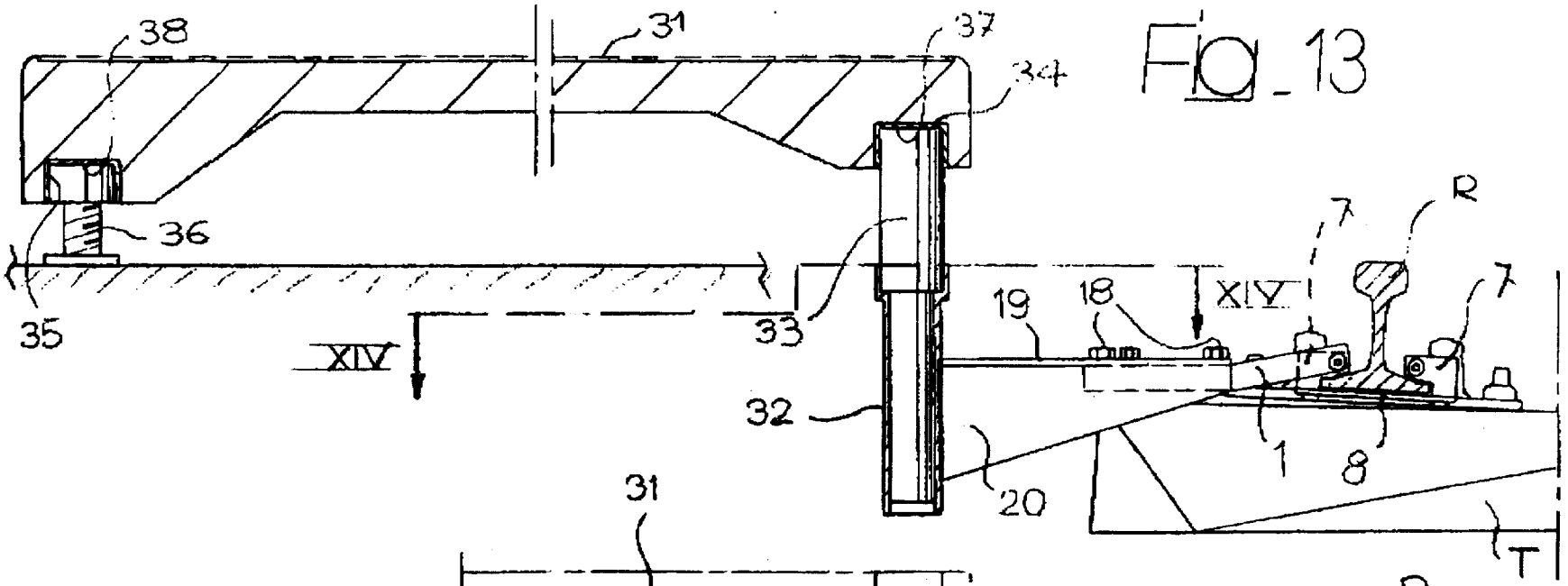
Figure 14:
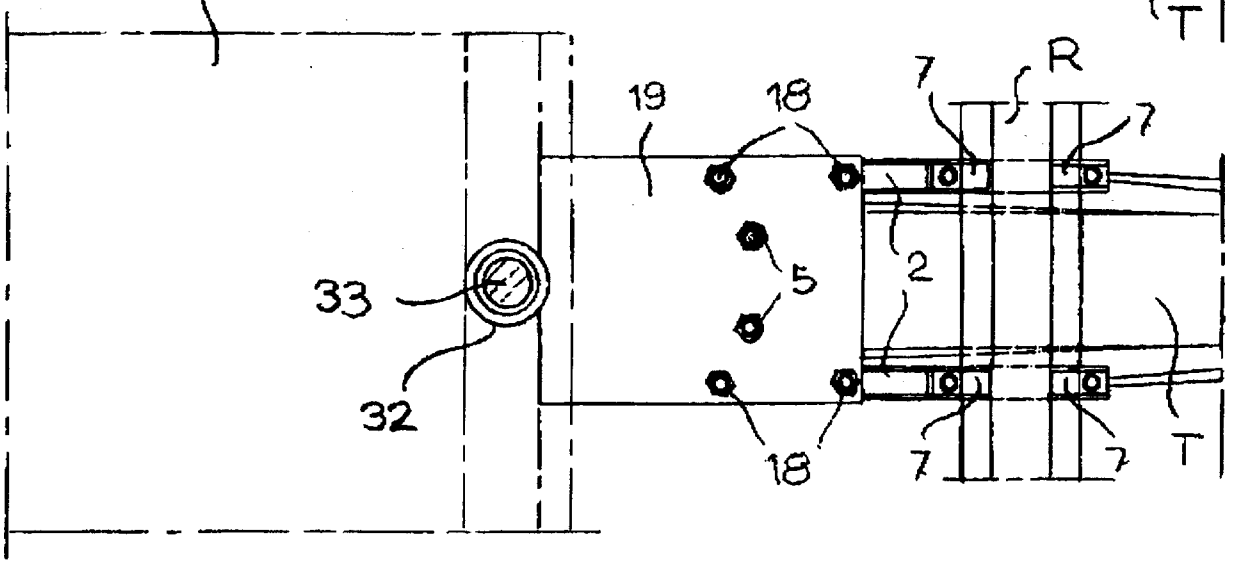
FIG. 14 is a top plan view of FIG. 13.
Figure 15:
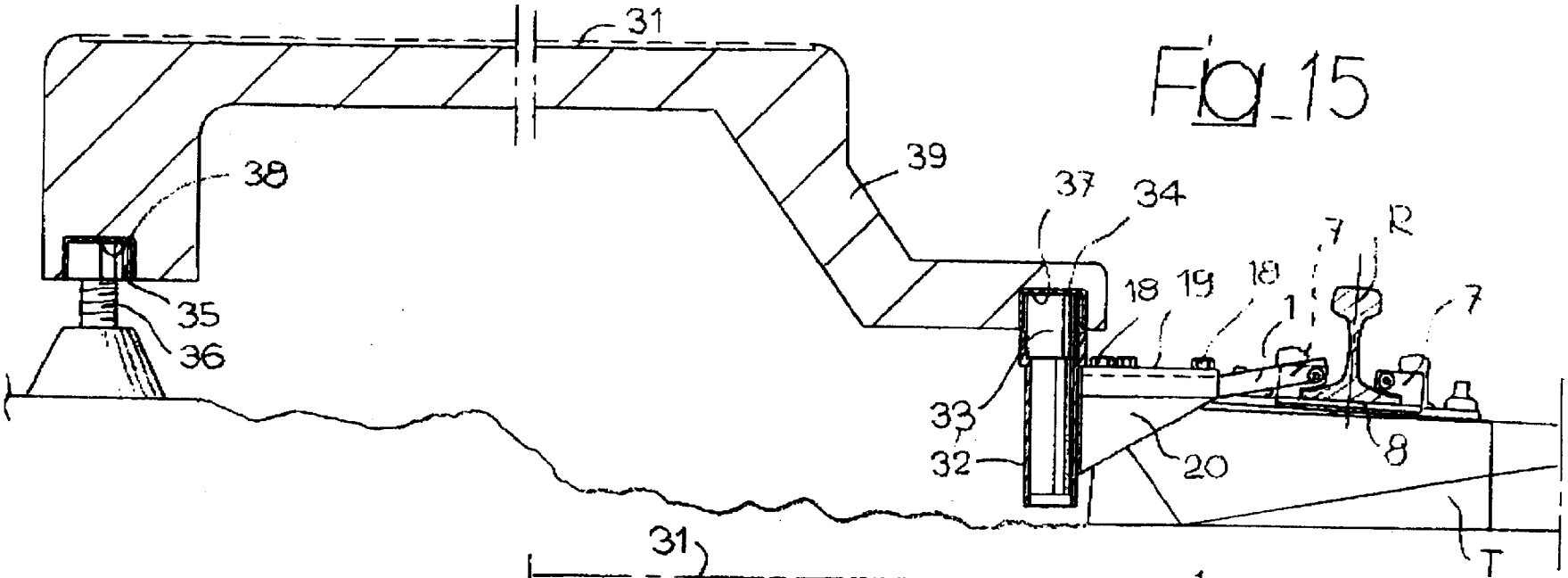
FIG. 15 is a view similar to that of FIG. 7, which shows a further example of use of the support device according to the invention.
Figure 16:
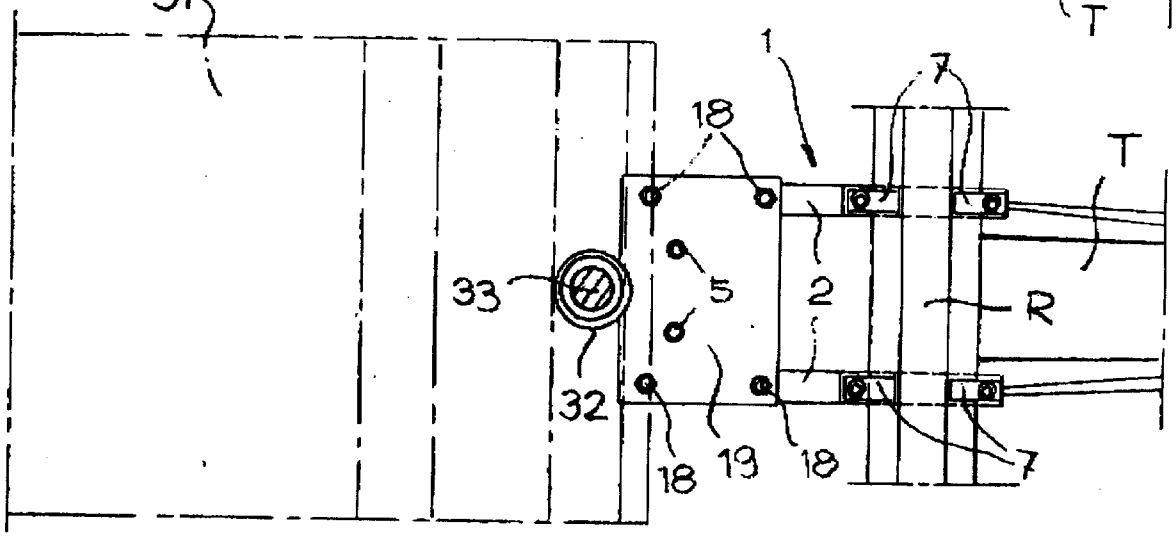
FIG. 16 is top plan view of FIG. 15.

The arrangement shown in FIGS. 15 and 16 is similar to the one shown in FIGS. 13 and 14, and refers in particular to the case where the treading surface 31 consists of a tramway platform. In this case, the tramway platform 31 has a lowered part 39 formed with a recess 37, into which the longitudinal guide 34 is inserted, and the strut 33 has a correspondingly reduced length.

Figure 17:
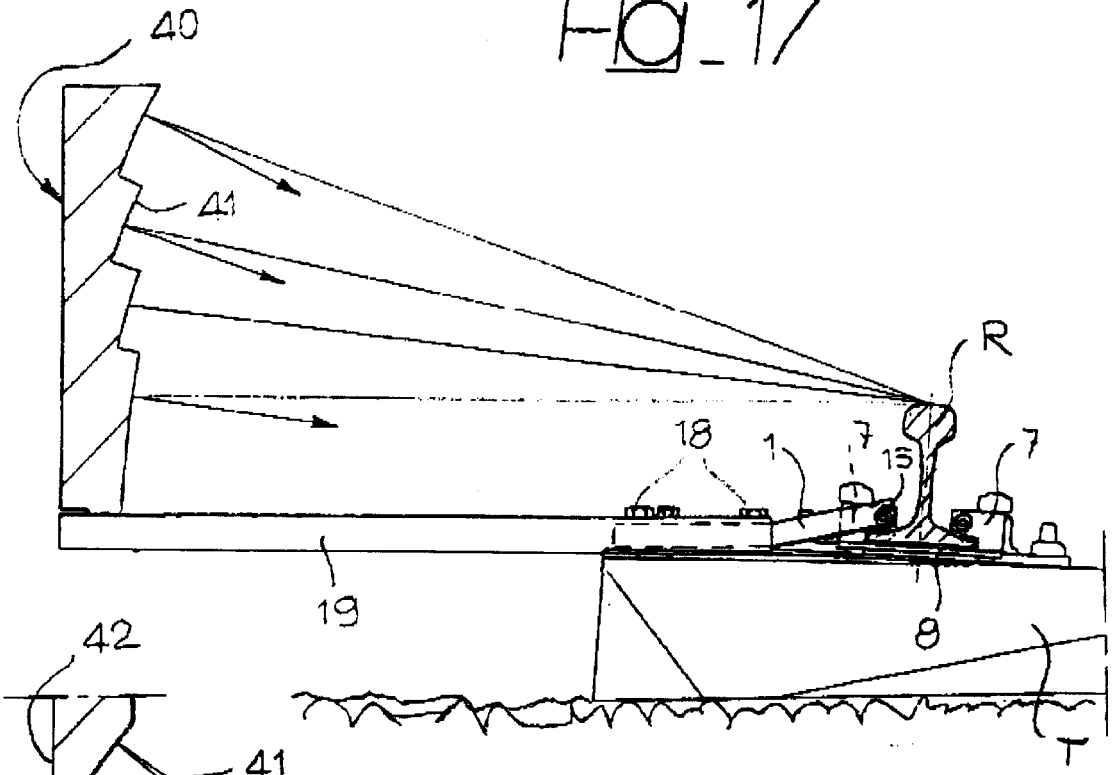
FIGS. 17–22 are views similar to that of FIG. 7, which illustrate further examples of use of the support device according to the invention.
Figure 18:
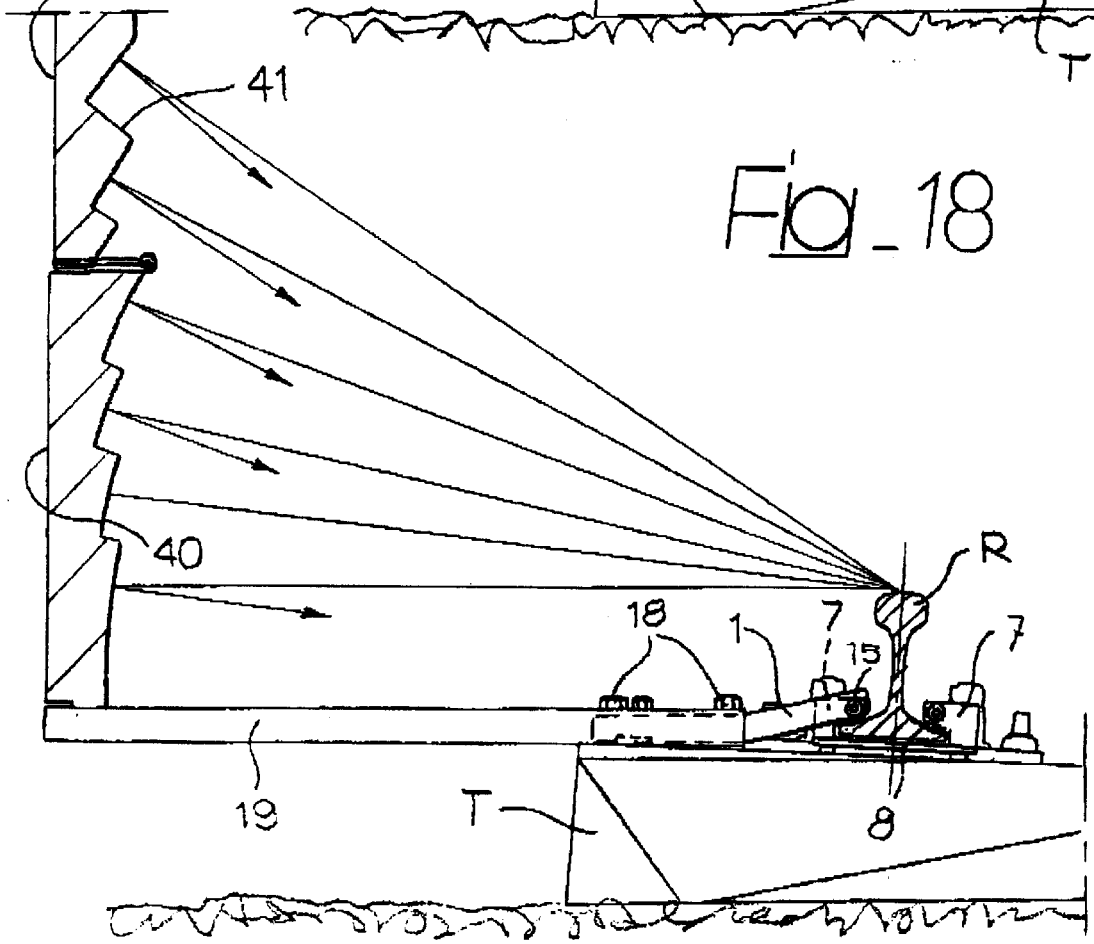

In the case of FIG. 17, the projecting service member 19 supports, at its free end, a sound barrier 40 having, for instance, a stepped surface 41 for reflection-shielding of the plane of the rail. The barrier 40 may be equipped with a top prolongation 42 that can be tipped down to enable transit on the railway track of trains with rolling stock out of clearance gauge, in the way represented in FIG. 18.

Figure 19:
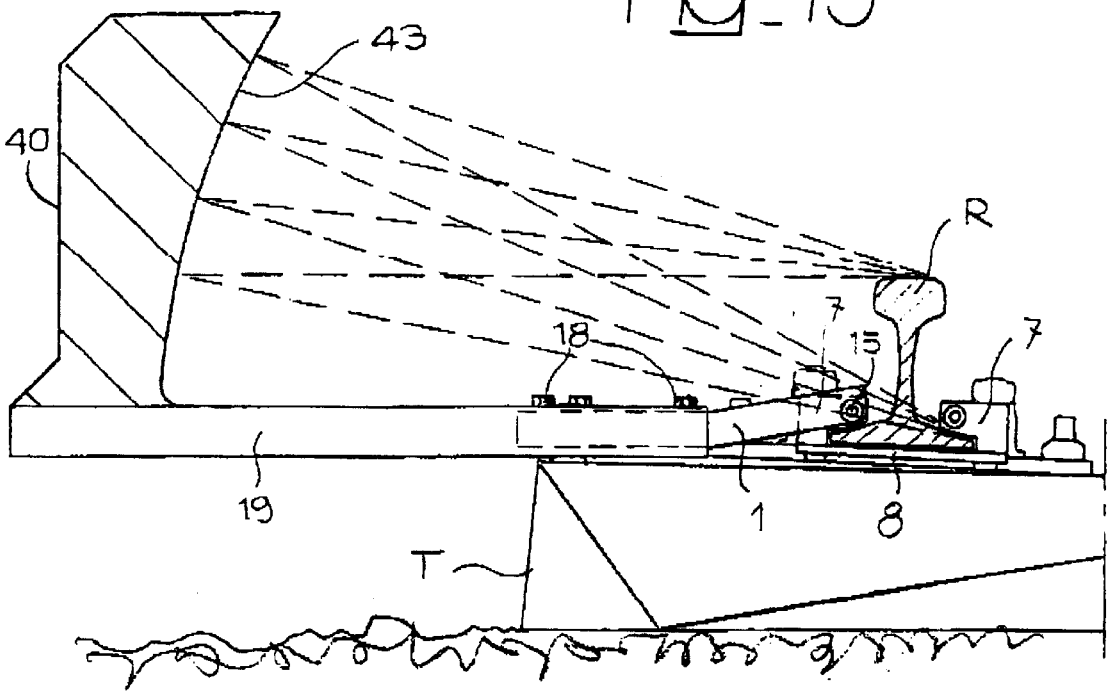

Alternatively, the sound barrier 40 can be built with an internal, concave, reflection surface 43, as illustrated in FIG. 19.

Figure 20:
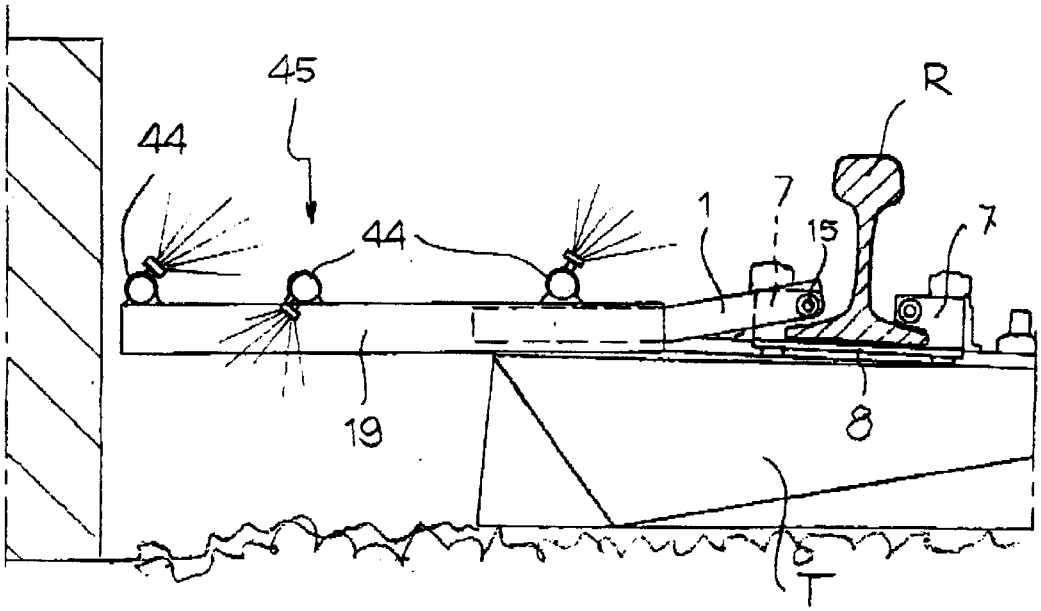

In the case of FIG. 20, the projecting service member 19 is arranged to support sets of manifolds and nozzles 44 of an automatic sprinkling system 45 for delivering, for example, disinfectant liquids in areas where the trains stop and in areas where cattle trucks stop.

Figure 21:
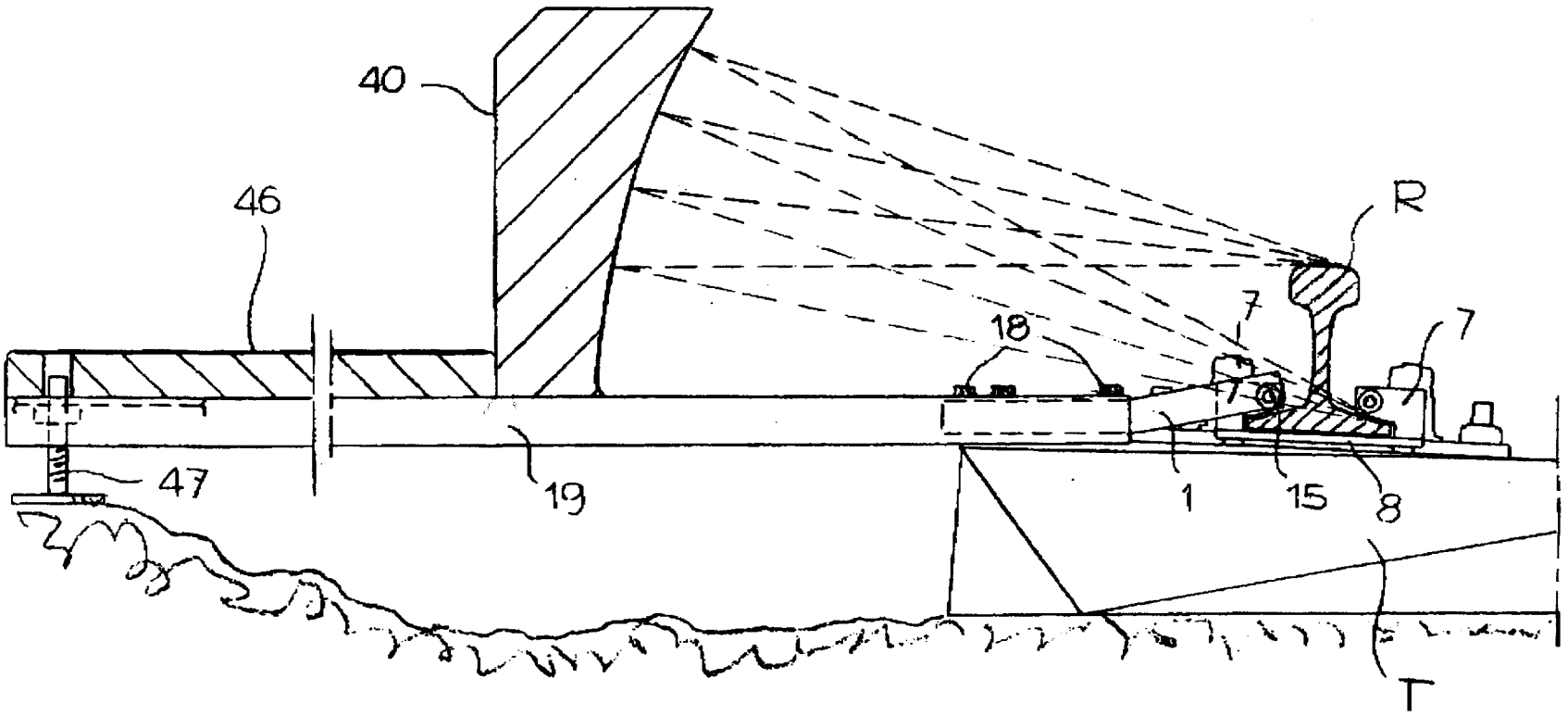

FIG. 21 shows a particular conformation of the service member 19 for supporting both a sound barrier 40 (for instance of the type described with reference to FIG. 19) and a platform 46 on the outside of the said sound barrier 40. In this case, taking into account the length of the projecting service member 19, an auxiliary strut 47 resting on the ground and normally screw-adjustable will be provided underneath the platform 46.

Figures 22, 23:
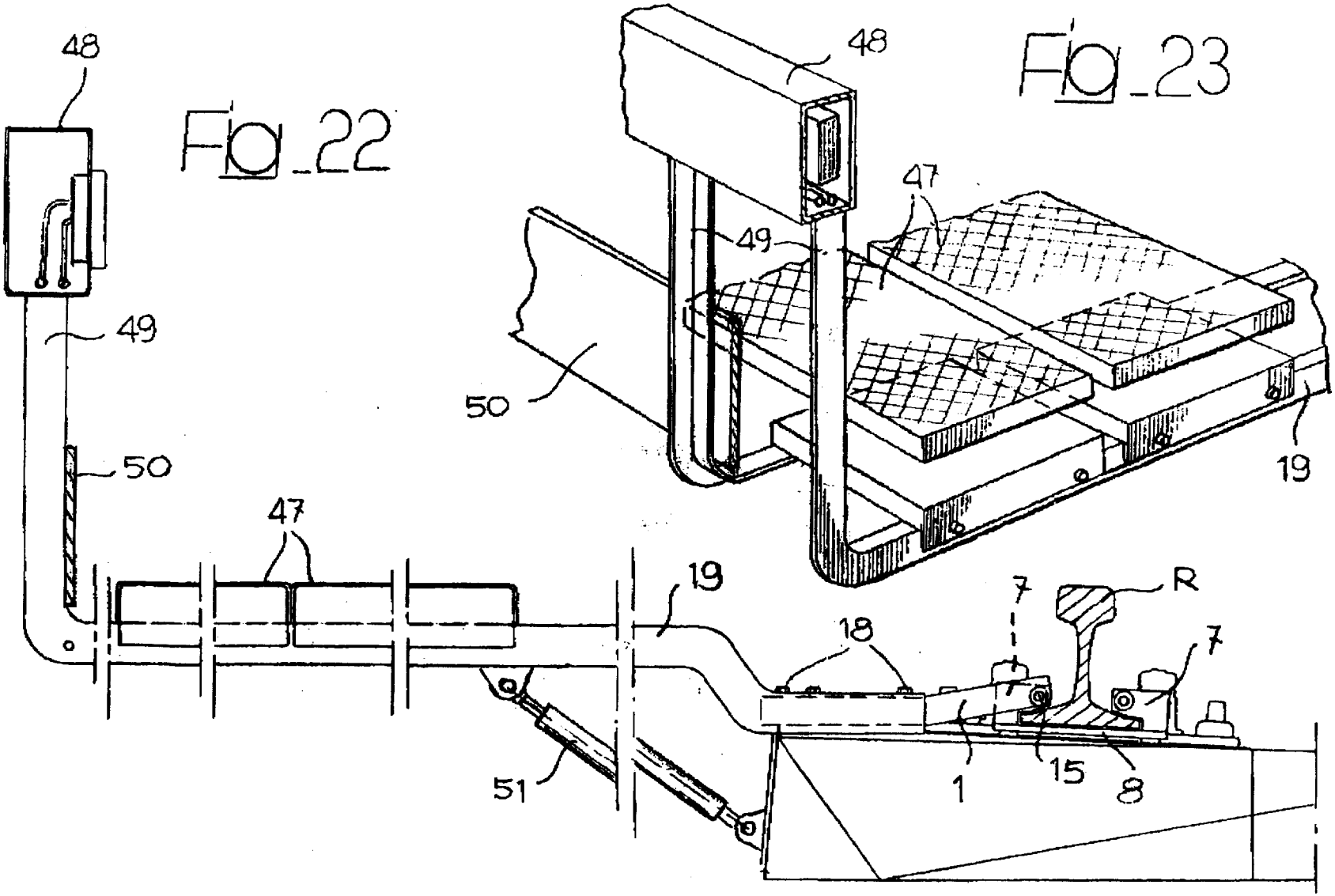
FIG. 23 is a partial perspective view of FIG. 22.

FIGS. 22 and 23 show another possible combination of use for the service member 19, fixed to the bracket 1 of the support device according to the invention, consisting of a double gangway 47, set horizontally, and of a duct 48 for electrical cables or the like carried at the top of a pair of arms 49 of the service member 19, which are bent upwards. At the base of the arms 49 there is moreover applied a vertical protective board or panel 50, and an adjustable strut 51 can be provided for auxiliary support of the service member 19, should its projecting length so require.

FIG. 24 shows an example of application in which, as is also illustrated in greater detail in FIG. 25, both the clamp blocks 7 of the support device are used for attachment of corresponding brackets 1. This arrangement, which is envisaged for both of the rails R of the track, may be used, for instance, for supporting, along the railway (or tram) line covers, which are external 52 and internal 53, for partial covering of the railway (or tram) track at the same level as the roadway. The side covers 52 are carried by corresponding projecting service members 19 which are in turn fixed to the bracket 1 corresponding to the external sides of the two rails R, whilst the internal covers 52 may be directly fixed to the brackets 1 that are connected to the internal sides of the two rails R.

Figure 26:
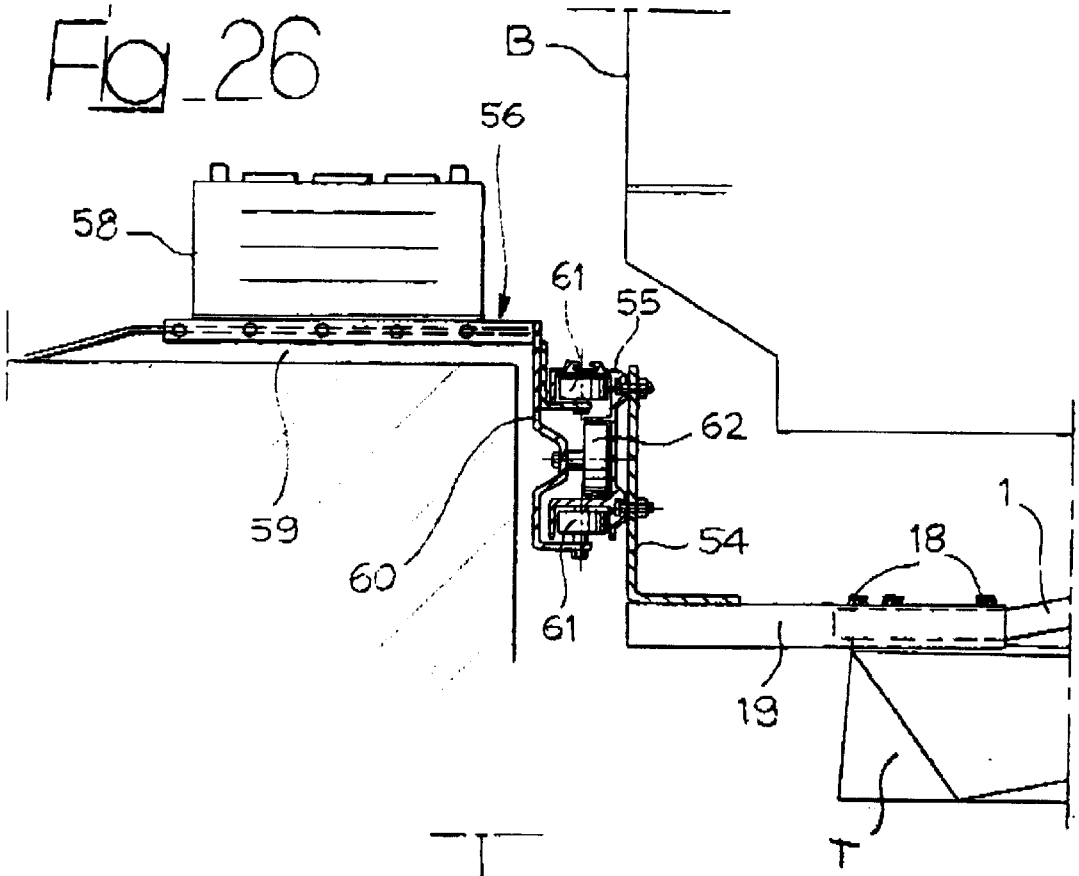

In the case of FIG. 26, the projecting service member 19 carries, by means of an end bracket 54 carrying a sectional element 55, which constitutes a longitudinal guide rail for an inserting assembly 56 for electrical storage batteries 58 which are to be installed on board the carriages B of railway vehicles. The aforesaid inserting assembly 56 comprises a platform 59 for the storage batteries 58, which is carried by a mobile structure 60 equipped with rollers having a vertical axis 61 and rollers having a horizontal axis 62, which are in rolling contact with the sectional guide element 55.

Figure 27:
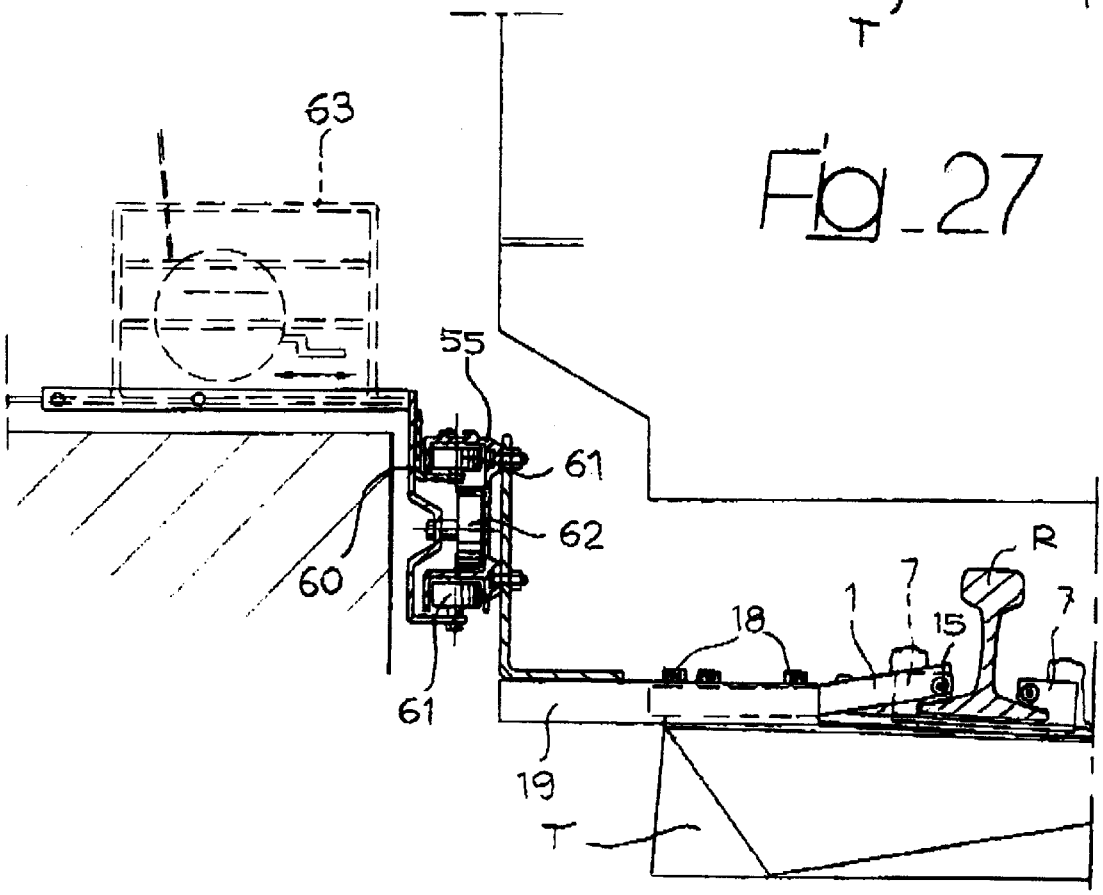

A similar arrangement is represented in FIG. 27, with reference to a lifting assembly, generically designated as 63 and designed for transfer of disabled persons on wheel chairs, goods, etc. from the platform to the railway vehicle.

Figures 28, 29:
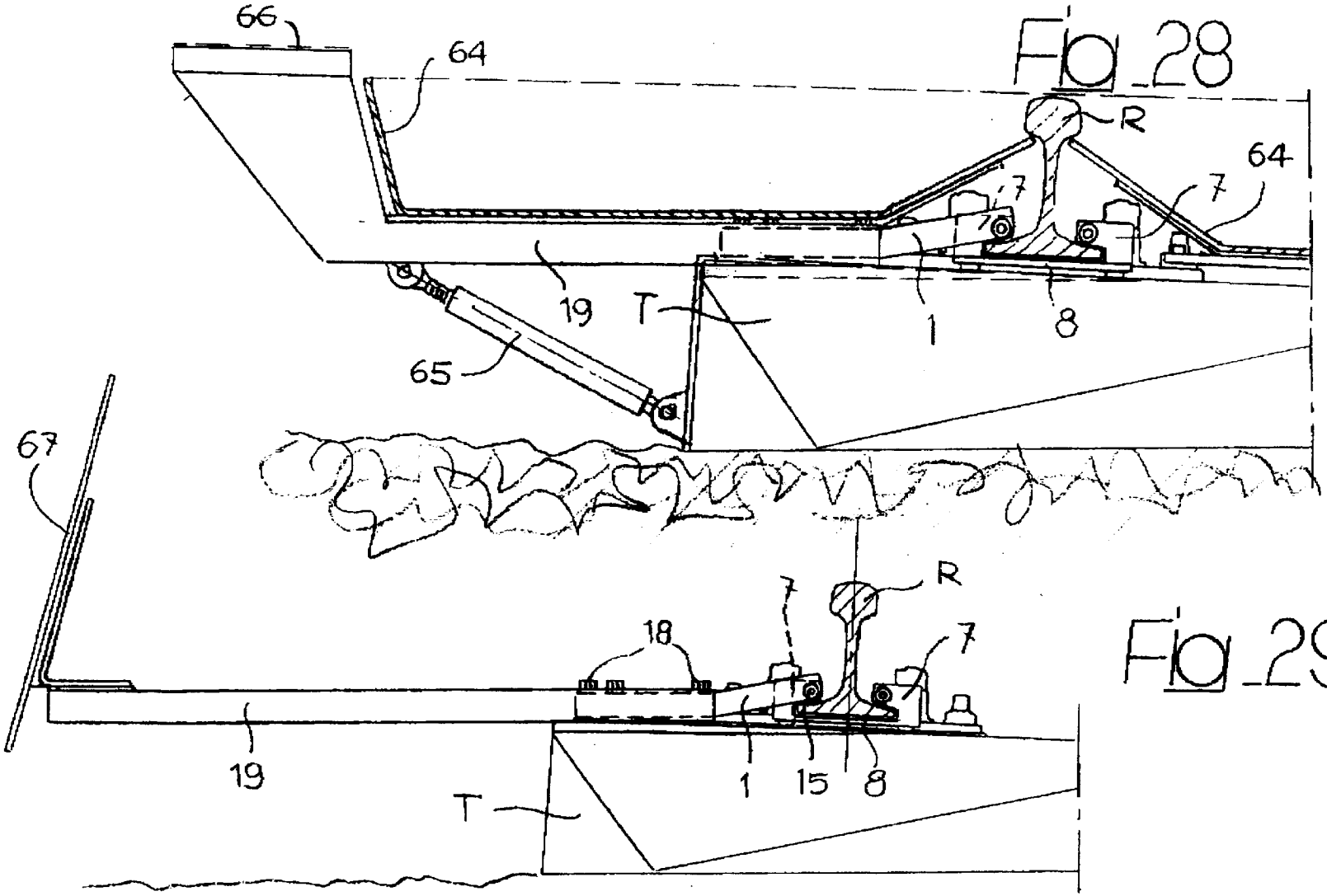

In the case of FIG. 28, the service member 19, fixed to the bracket 1 of the support device according to the invention, is shaped in such a way as to support a tank 64 for liquids for washing and/or disinfecting the undercarriage part of railway (tram) wagons or coaches. This system can also be used in combination with the sprinkling system described with reference to FIG. 20.

Also in this case, the service member 19 may be further supported by an adjustable strut 65, which reacts with the end of the sleeper T and can be shaped (in a way substantially similar to the one described with reference to FIG. 9) to support also a gangway 66 on the external side of the tank 64.

Similar tanks 64 may be provided not only at points corresponding to the other rail of the track, but also in the intermediate area between the two rails themselves, as is again partially visible in FIG. 28.

In the case of FIG. 29, the projecting service member 19 carries, at its free end, a stone barrier 67 for protection of the rail R.

Figures 30, 31:
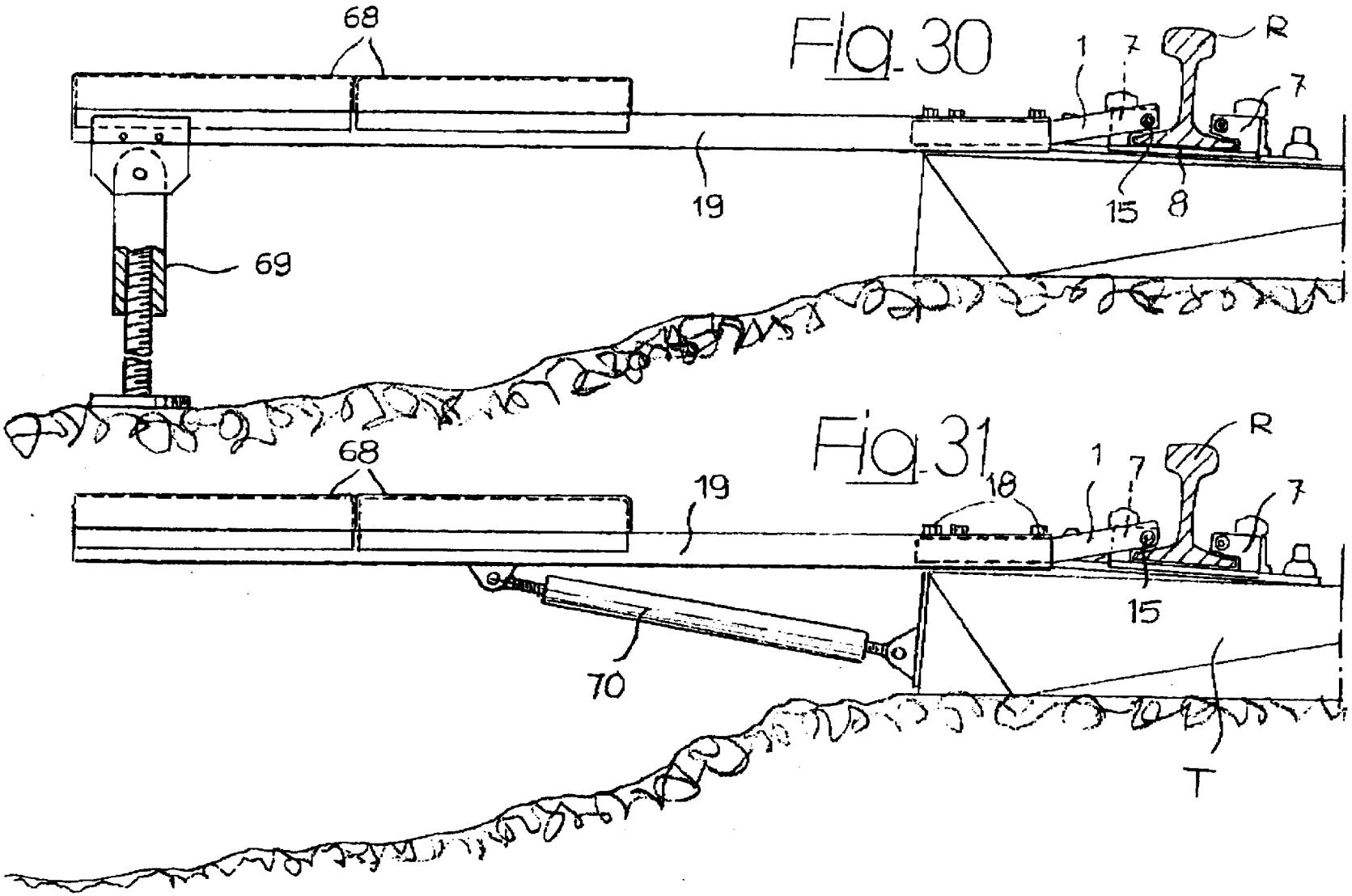
Figure 32:
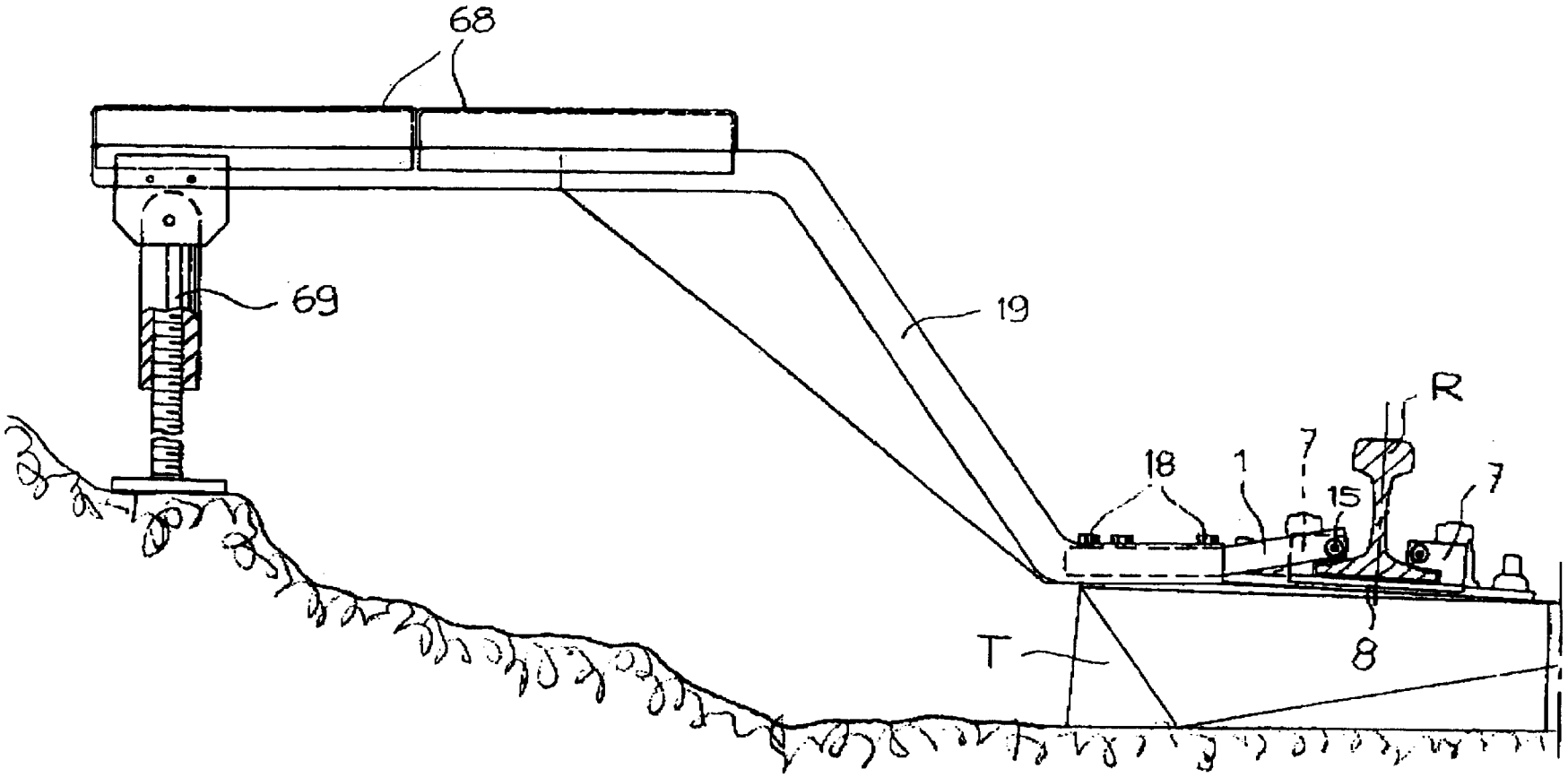

FIGS. 30, 31 and 32 show further modes of use of the support device according to the invention, in which the service member 19, bearing horizontal gangways set alongside one another, instead of being set in cantilever fashion, is supported by screw-adjustable struts 69, 70, respectively set vertically at the free end of the service member 19 (possibly raised up as in the case illustrated in FIG. 32), or obliquely between the median portion of the service member 19 and the end of the sleeper T. FIG. 33 shows a possible mode of slotting attachment between the ends of the gangways 68 and the service member 19, in this case. consisting of a single arm.

Figure 35:
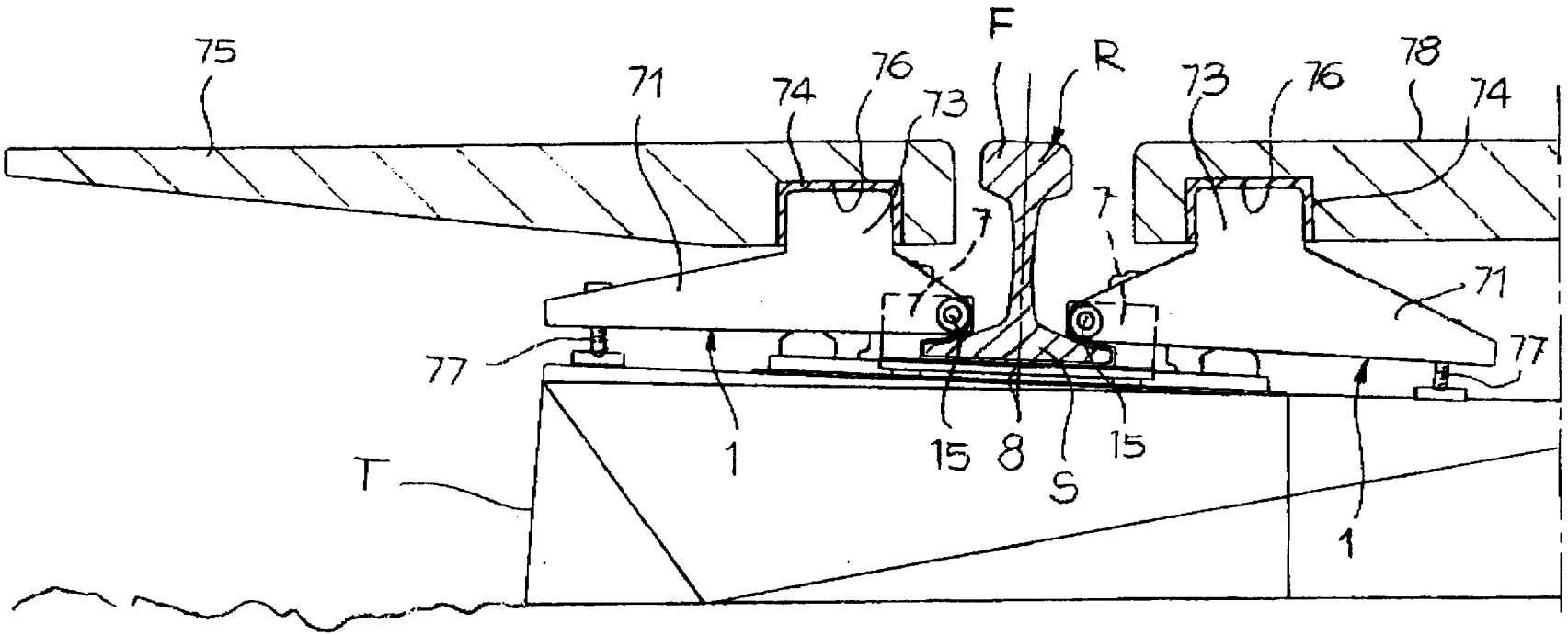
FIG. 35 is a cross-sectional view, at a larger scale, illustrating the support device of FIG. 34 in the condition of use.

FIGS. 34 and 35 show a variant of the bracket 1, designated by la, in which each of the two arms 2 of the embodiment previously described is replaced by a pair of vertical plates 71 which have a generally triangular shape, are set at a distance apart, and are connected together at one end by pine 72 for connection to the clamp blocks 7, and at the other end are connected together and to the other pair of plates 71 of the cross member 3.

The plates 71 are shaped at the top with projecting parts 73 for engagement of inverted-channel section 74, which is turn is designed for slot engagement of a platform 75 having underneath a longitudinal recess 76 with a shape complementary to that of the inverted-channel section 74. The platform 75 can thus be easily disassembled to enable, for example, ballasting operations on the railway track.

With this embodiment, the projecting service member 19 is eliminated, and the base plate 4 of the embodiment previously described may be replaced with a screw-adjustable resting block 77 set on the sleeper T.

Figure 36:
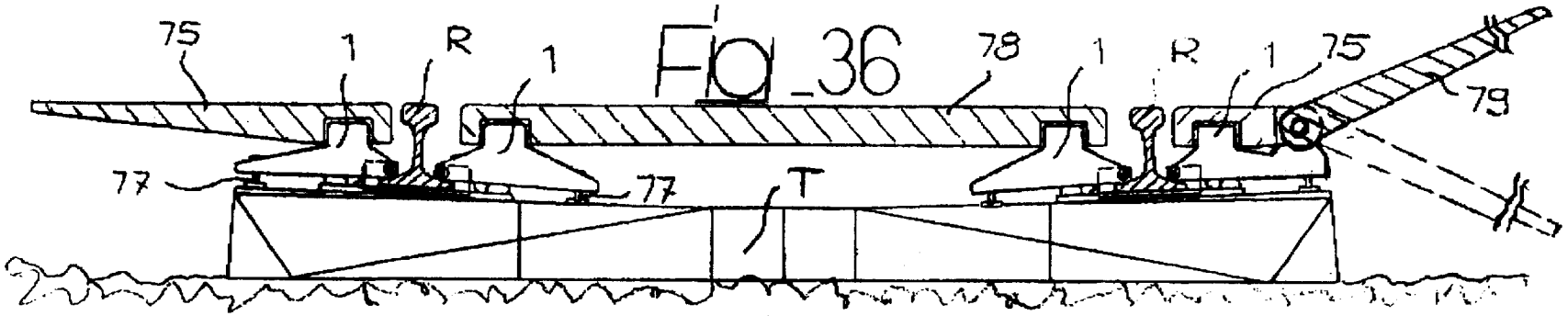
FIG. 36 is a view similar to that of FIG. 5, but at a reduced scale, illustrating a pair of support devices, according to FIG. 34, applied to the two rails of a railway track.
Figure 37:
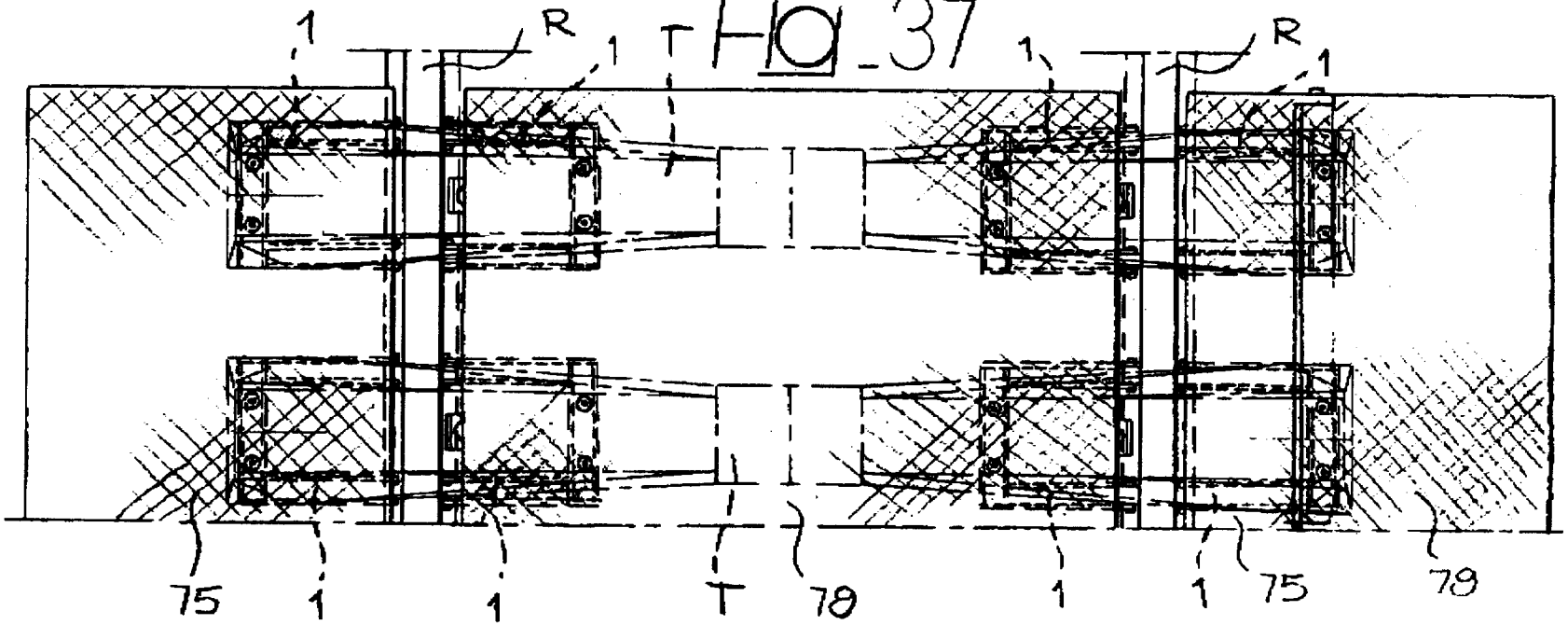
FIG. 37 is a top plan view of FIG. 36.

As illustrated in FIG. 35, the same arrangement may be provided also on the internal side of the rail R, for support of an intermediate gangway 78 set between the two rails of the railway track, the said intermediate gangway 78 being at the same level as the tops of the heads F of the two rails R. This arrangement thus defines, as is illustrated also in FIGS. 36 and 37, a level crossing of the railway track, in which the two side plates 75 may be wholly or partially orientable, for example using a respective articulated end portion, designated by 79 in the right-hand part of FIGS. 36 and 37. This makes available ascending. or descending ramps usable for facilitating crossing of the railway track. for example for military and/or civil-defence purposes (for rescue, emergencies, etc.).

Figure 38:
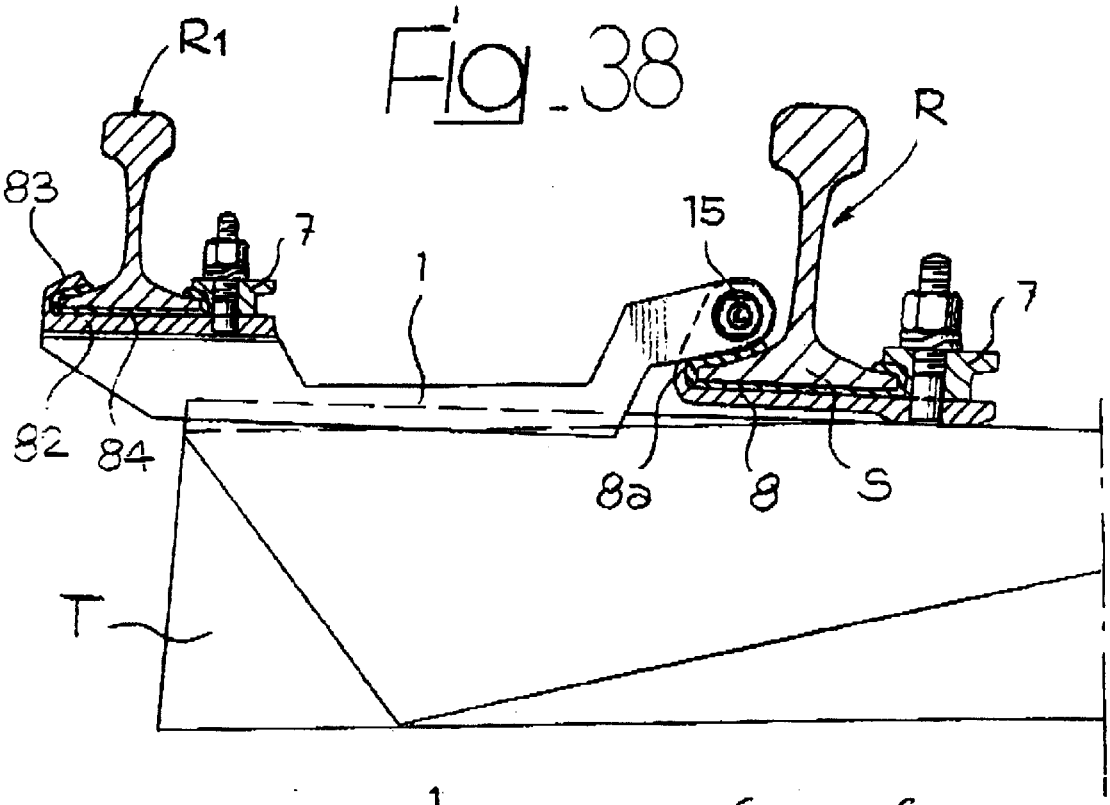
FIG. 38 is a view similar to that of FIG. 7, at a slightly larger scale, illustrating a further variant of the support device according to the invention in a further possible application.

FIG. 38, and also FIGS. 40–43, illustrate a variant of the support device according to the invention, in which the clamp blocks 7 set on one side of the flange S of the rail R are eliminated and replaced by a flange 8 a which is integral with the bottom plate 8 and is bent according to a shape complementary to that of said side of the flange S. In this case, the bracket 1 can be connected to the bent-back flange 8*a* in an articulated way by means of one or more bolts 15, as in the embodiment described previously, or else it may be joined to said flange 8*a* without any oscillation being possible, as is illustrated in FIGS. 40 and 43. In both cases, between the bracket 1 (which also in this case may be made of metal or of plastic material) and the flange 8*a* a further electrically insulating, and possibly vibration-damping element, may be set, which is designated in one case by 80 and in the other case by 81. In the case of FIG. 38, the bracket 1 (more conveniently made of plastic, or in any case of an electrically insulating material) supports, by means of a place 82 with a flange 83 bent back and a clamp block 7 metropolitan underground railways. Between the third rail $R_1$ and the plate 82 with bent-back flange 83 and the clamp block 7, an insulating and vibration-damping layer 84 may be set.

In the case of FIG. 41, the bracket 1, instead of being connected to the bent-back flange 8*a* of the base plate a, is carried by a bracket appendage 85 of said base plate 8 projecting from the internal side of the rail R, beyond the clamp block 7. Also in this case, the bracket 1 is connected to the appendage 85 with interposition of an insulating and vibration-damping element 86.

In all the embodiments illustrated in FIGS. 38 and 40–43, the clamp block 7 presents a conformation slightly different from the one described previously. It in fact presents a general asymmetrical-T conformation so as to be used, rotated through 180°, with rails R the flanges S of which have different profiles (for example, UNI 50 or UNI 60 ).

Figure 39:
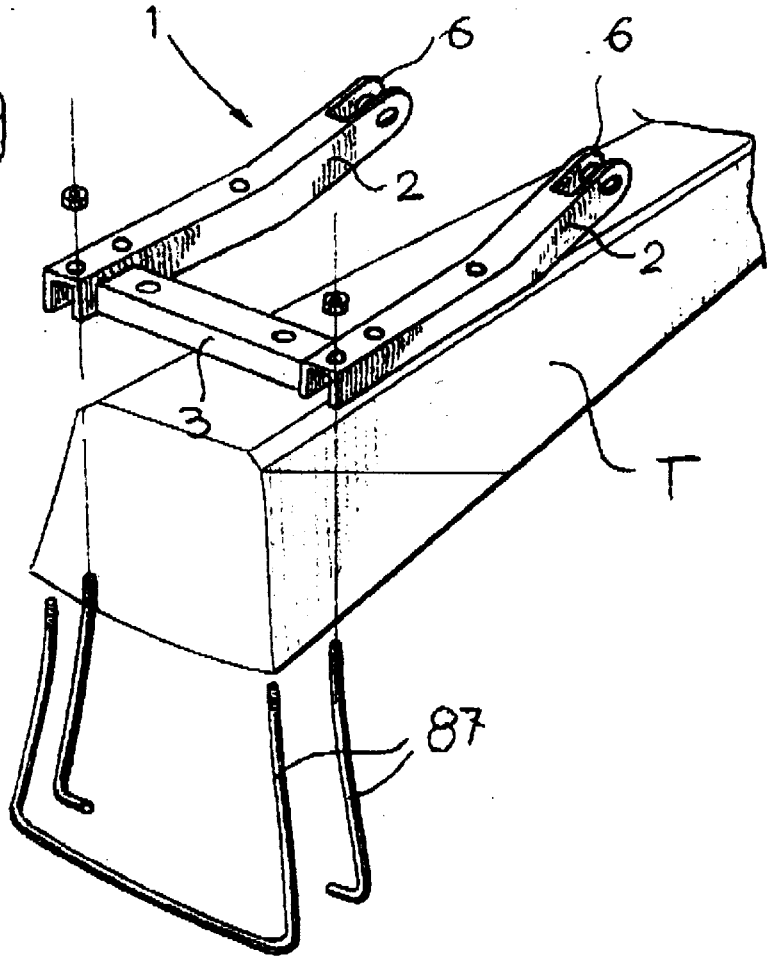
FIG. 39 is a perspective view of another variant of the support device.

It should be noted that in all the embodiments described above, the bracket 1, connected to one end of the flange S of the rail R and resting in the vicinity of the opposite end on the sleeper T, may moreover be rigidly fixed to the latter, for example in the way represented in FIG. 39, with the aid of U-bolts, designated by 87, set astride the sleeper T.

Of course, the details of construction and the embodiments may vary widely with respect to what is described and illustrated herein, without thereby departing from the scope of the present invention as defined in the ensuing claims.

What is claimed is:

1. A support device to be applied to rails (R) of railway or tram tracks that include sleepers (T) set at spaced apart intervals and in which said rails (R) have flanges (S) fixed to said sleepers (T), said support device including a bracket (1) having attachment parts (6) for attachment to one of said rails, on opposite sides of one of said sleepers; a resting part (4) intended to rest on said one of said sleepers and is spaced from said attachment parts (6); and mechanical connection means (7, 8) for connecting said attachment parts (6) to the flange (S) of said one of said rails, characterized in that said connection means include clamp members (7, 8) for both sides of the flange (S) of said one of said rails.

2. A device according to claim 1, characterized in that said attachment means (6) are articulated to said clamp members (7) about a common axis (15) which is parallel to said one of said rails.

3. A device according to claim 2, characterized in that said resting part (4) for supporting said bracket (1) on said one of said sleepers is height-adjustable.

4. A device according to claim 1, characterized in that said clamp members include substantially L-shaped blocks (7), each of which has a vertical anchoring branch (9) and at least one horizontal branch (12) which can engage on top of the flange (S) of said one of said rails, a base plate (8) which can be positioned underneath the flange (8) of the rail (R), and screw-tightening means (10) between said vertical branch (9) and said base plate (8).

5. A device according to claim 4, characterized in that said at least one horizontal branch (12) has a transverse through hole (13) for engagement of a bolt (15) for connection to a corresponding attachment part of said bracket (1).

6. A device according to claim 5, characterized in that between said through hole (13) and said connection bolt (15) is set a bushing (14) made of vibration-damping material.

7. A device according to claim 4, characterized in that said connection means comprises a pair of said clamp blocks (7) which can be both fixed to said base plate (8).

8. A device according to claim 4, characterized in that said base plate (8) has, on the side opposite to said at least one block (7) a bent-back integral flange (8 a) which can engage on top of the flange (S) of said one of said rails.

9. A device according to claim 4, characterized in that said connection means comprises a body (16) made of electrically insulating material designed to be set between said base plate (8) and said at least one block (7) on one side, and said flange (S) the rail (R) on the other side.

10. A device according to claim 9, characterized in that said electrically insulating body (16) is made of vibration-damping material.

11. A device according to claim 1 characterized in that said connection means comprises fixing means (87) between said bracket (1) and said one of said sleepers.

12. A rail (R) for railway or tram tracks, comprising a plurality of support devices according to claim 1.

13. A support device to be applied to rails (R) of railway or tram tracks that include sleepers (T) set at spaced apart intervals and in which said rails (R) have flanges (S) fixed to said sleepers (T), said support device including a bracket (1) having attachment parts (6) for attachment to one of said rails, on opposite sides of one of said sleepers; a resting part (4) intended to rest on said one of said sleepers and is spaced from said attachment parts (6); and mechanical connection means (7, 8) for connecting said attachment parts (6) to the flange (S) of said one of said rails, characterized in that said bracket (1) comprises a pair of parallel arms (2), each of which has a forked-shaped end (6) defining a corresponding attachment part, and a cross member (3) which joins said two arms (2) at opposite ends (2*c*) of said tow arms(2).

14. A device according to claim 13, characterized in that each of said two arms (2) presents an internal inclined portion (2*a*) carrying said fork-like end (6), and an external horizontal portion (2*b*) joined to said cross member (3).

15. A device according to claim 13, characterized in that said two arms (2) present an inverted-channel conformation, and in that said bracket comprises a service member (19) which can be fixed in cantilever fashion between within said two arms (2).

16. A device according to claim 15 characterized in that, operatively associated to said projecting service member (19), is an auxiliary supporting strut (30; 47; 51; 65; 69; 70).

17. A device according to claim 13 characterized in that each of said arms is made up of a pair of contiguous vertical plates (71) provided with corresponding upper protruding parts (73) for engagement of sectional resting elements (74) which are substantially shaped like an inverted channel and are set parallel to said one of said rails so as to support horizontal platform (75, 78).

18. A support device to be applied to rails (R) of railway or tram tracks that include sleepers (T) set at spaced apart intervals and in which said rails (R) have flanges (S) fixed to said sleepers (T), said support device including a bracket (1) having attachment parts (6) for attachment to one of said rails, on opposite sides of one of said sleepers; a resting part (4) intended to rest on said one of said sleepers and is spaced from said attachment parts (6); and mechanical connection means (7, 8) for connecting said attachment parts (6) to the flange (S) of said one of said rails, characterized in that said bracket (1) is arranged for supporting a service device chosen from among:

treading surfaces and platforms (20; 23; 24; 28; 31; 46; 47; 66; 68; 75, 78);

transit platforms (31; 52, 53; 75, 78);

sound barriers (26, 40, 42);

visual and acoustic signaling devices (20);

ducts for electrical cables (21; 48);

auxiliary rails (R1, 55);

level crossings (52, 53; 75, 78);

safety barriers (29; 50; 67);

tanks for washing/disinfecting liquids (64);

sprinkling/washing systems (45);

transportation systems (56); and lifting systems (63).

* * * * *

UNITED STATES PATENT AND TRADEMARK OFFICE

CERTIFICATE OF CORRECTION

PATENT NO. : 6,443,363 B1
DATED : September 3, 2002
INVENTOR(S) : Eleonora Fasano It is certified that error appears in the above-identified patent and that said Letters Patent is hereby corrected as shown below:

Title page,
Item [73], should read as:

-- [73] Assignee: Effebi Technologies S.r.l., Vercelli (IT)
Eleonora Fasano, Villarbasse (IT); part interest to each --

Signed and Sealed this

Twenty-first Day of January, 2003

JAMES E. ROGAN
*Director of the United States Patent and Trademark Office*